US006700593B2

(12) United States Patent
Otsuki

(10) Patent No.: US 6,700,593 B2
(45) Date of Patent: Mar. 2, 2004

(54) DETERMINATION OF VALUE OF ADJUSTMENT FOR RECORDING POSITION VARIATION IN PRINTING USING TWO TYPES OF INSPECTION PATTERN

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 37 days.

(21) Appl. No.: 10/048,287

(22) PCT Filed: May 25, 2001

(86) PCT No.: PCT/JP01/04425

§ 371 (c)(1),
(2), (4) Date: Jan. 29, 2002

(87) PCT Pub. No.: WO01/92015

PCT Pub. Date: Dec. 6, 2001

(65) Prior Publication Data

US 2002/0105558 A1 Aug. 8, 2002

(30) Foreign Application Priority Data

May 29, 2000 (JP) ..... 2000-157666

(51) Int. Cl.[7] ..... B41J 29/393
(52) U.S. Cl. ..... 346/19; 347/19
(58) Field of Search ..... 347/19, 40–43, 347/37, 12; 400/74; 358/406, 504

(56) References Cited

U.S. PATENT DOCUMENTS 4,198,642 A 4/1980 Gamblin
5,069,556 A * 12/1991 Sasaki et al. ..... 400/74
6,082,911 A * 7/2000 Murakami ..... 400/74
6,084,606 A * 7/2000 Moriyama ..... 347/19
6,267,519 B1 * 7/2001 Otsuki et al. ..... 400/238
6,281,908 B1 * 8/2001 Gibson et al. ..... 347/19

FOREIGN PATENT DOCUMENTS

| | | |
|---|---|---|
| EP | 0 631 257 A2 | 12/1994 |
| EP | 0 874 329 A2 | 10/1998 |
| EP | 0 895 869 A2 | 2/1999 |
| EP | 0 947 323 A2 | 10/1999 |
| EP | 1 002 651 A2 | 5/2000 |
| EP | 1 027 999 A2 | 8/2000 |
| JP | 5-69625 | 3/1993 |
| JP | 7-81190 A | 3/1995 |
| JP | 11-48587 | 2/1999 |

* cited by examiner

*Primary Examiner*—An H Do
(74) *Attorney, Agent, or Firm*—Sughrue Mion, PLLC

(57) ABSTRACT

An adjustment value for adjusting a recording misalignment in the direction of main scanning is determined with high efficiency. The value is used when ink drops are ejected from nozzles to form dots on a print medium. The present invention entails determining adjustment values designed to reduce dot formation misalignments in the direction of main scanning during a printing process. A printing device equipped with a plurality of single-color nozzle groups for ejecting ink drops having mutually different colors is used to form dots while main scanning is performed. In the process, a first adjustment value is selected from a plurality of first possible adjustment values by means of a first misalignment verification pattern. In addition, a second misalignment verification pattern that is different from the first misalignment verification pattern is used to set a second adjustment value from a plurality of second possible adjustment values. The second possible adjustment values are selected from the vicinity of the first adjustment value.

37 Claims, 14 Drawing Sheets

Sub-scan feed amount: constant at 3 dots

Sub-scan feed amount: non-constant feeding (5 + 2 + 3 + 6 dots)

DETERMINATION OF VALUE OF ADJUSTMENT FOR RECORDING POSITION VARIATION IN PRINTING USING TWO TYPES OF INSPECTION PATTERN

BACKGROUND OF THE INVENTION

1. Field of the Invention

The present invention relates to a technique for printing images by forming dots on a print medium during main scanning, and more particularly to a technique for determining an adjustment value for correcting the recording misalignment of dots in the direction of main scanning.

2. Description of the Related Art

Colorprinters having a head for ejecting several color inks are currently used on a wide scale as the output devices for computers. Some color printers print images by ejecting ink drops from nozzles to form dots on a print medium during main scanning.

In a printing operation in which ink drops are ejected from nozzles to form dots on the print medium, the recording positions of the dots sometimes become misaligned due to the backlash of the drive mechanism in the direction of main scanning, the warping of the platen that supports the print medium from below, and the like. The method disclosed in JP 5-69625A, filed by the present applicant, is known as an example of a technique aimed at preventing such misalignments. According to this conventional technique, adjustment values designed to cancel out the misalignment of dot formation in the direction of main scanning are registered in advance, and the recording positions in the forward and reverse passes are corrected based on these adjustment values.

Some color printers have a so-called bidirectional printing feature whereby ink drops are ejected both in the forward pass and reverse pass of main scanning in order to increase the printing speed. The aforementioned correction method can be used to prevent formed dots from being misaligned in the forward and reverse passes during such bidirectional printing. The aforementioned correction method can also be used to prevent formed dots from being misaligned among a plurality of nozzles during so-called unidirectional printing, in which ink drops are ejected only in either forward pass or reverse pass of main scanning.

With such conventional correction methods, however, it is difficult to provide optimal settings aimed at preventing printed images from acquiring graininess due to misaligned dot formation.

An object of the present invention, which was devised in order to overcome the above-described shortcomings of the prior art, is to achieve high efficiency in setting an adjustment value for adjusting a recording misalignment in the direction of main scanning when ink drops are ejected from nozzles to form dots on a print medium.

SUMMARY OF THE INVENTION

Aimed at partially addressing the above-described problems, the present invention entails setting adjustment values designed to reduce dot formation misalignments in the direction of main scanning during a printing process. In the printing process, a printing device equipped with a plurality of single-color nozzle groups for ejecting ink drops having mutually different colors is used. The printing device deposits the ink drops to form dots on a print medium while the plurality of single-color nozzle groups and/or the print medium is moved in a main scan. In the setting adjustment values, a first adjustment value is selected from a plurality of first possible adjustment values using a first misalignment verification pattern. A second adjustment value is selected from a plurality of second possible adjustment values using a second misalignment verification pattern, which is different from the first misalignment verification pattern. Adopting this approach makes it possible to set first and second adjustment values on the basis of actual print results. It is also possible to take into account different traits by setting adjustment values on the basis of different misalignment verification patterns.

It is preferable that the plurality of second possible adjustment values are set in a vicinity of the first adjustment value. Adopting this approach makes it possible to efficiently set a second adjustment value on the basis of a first adjustment value.

In setting of the second adjustment value, the second adjustment value may preferably be selected from the plurality of second possible adjustment values whose difference is less than the difference between the plurality of first possible adjustment values respectively. Adopting this approach makes it possible to set second adjustment values in smaller increments without analyzing a large volume of possible adjustment values.

In setting of the first adjustment value, the first misalignment verification pattern may preferably be formed on a print medium by one or more single-color nozzle groups, wherein the first misalignment verification pattern contains a plurality of first sub-patterns associated with the plurality of first possible adjustment values. The first adjustment value may preferably be set in accordance with correction information about a preferred corrected state selected from the first misalignment verification pattern. In setting of the second adjustment value, the second misalignment verification pattern may preferably be formed on a print medium by two or more of the single-color nozzle groups, wherein the second misalignment verification pattern contains a plurality of second sub-patterns associated with the plurality of second possible adjustment values respectively. The second adjustment value may preferably be set in accordance with correction information about a preferred corrected state selected from the second misalignment verification pattern. With this approach, a second adjustment value can be set on the basis of an evaluation involving two or more ink colors.

The following procedure should preferably be adopted when the first misalignment verification pattern is formed. First ruled lines each contained in the first sub-pattern and oriented in a direction that intersects the direction of main scanning may be printed. Second ruled lines each contained in the first sub-pattern, oriented in a direction that intersects the direction of main scanning and associated with the first ruled line may be printed. With this approach, an appropriate first adjustment value can be set based on the relation between the relative positions of the first and second ruled lines.

The following procedure should preferably be adopted when the adjustment value is a value designed to reduce a dot formation misalignment occurring in the direction of main scanning in the course of a printing process in which ink drops are deposited and dots are formed on a print medium while main scanning is performed in opposite directions. In the printing of the first ruled lines, the first ruled lines may be printed in a forward pass of the main scan. In the printing of the second ruled lines, the second ruled lines are printed in a reverse pass of the main scan.

Adopting this approach allows an appropriate first adjustment value to be set based on the relation between the relative positions of first ruled lines which reflect the dot formation misalignment of a forward pass, and second ruled lines, which reflect the dot formation misalignment of a reverse pass. The first adjustment value such decided may reduce any dot formation misalignments occurring during bidirectional printing.

In the printing of first ruled lines, the first ruled lines may preferably be printed by a specific single-color nozzle group. In the printing of second ruled lines, the second ruled lines may preferably be printed by a single-color nozzle group that is different from the single-color nozzle group used in the printing of the first ruled lines. With this approach, it is possible to set an appropriate first adjustment value for reducing dot formation misalignments between pairs of different single-color nozzle groups.

In the printing of the second misalignment verification pattern, uniform color patches may preferably be formed as the second sub-patterns. With this approach, a second adjustment value capable of providing print results with higher picture quality can be selected in an efficient manner when the aim is to perform uniformly dense printing.

In the printing of the second misalignment verification pattern, the second sub-patterns may preferably be formed by forming dots such that a value of 0.5–2.5 mm is selected for intervals between the dots formed by ink drops ejected from nozzles in a same single-color nozzle group. With this approach, preferred second sub-patterns can be visually selected with ease. Data concerning the second sub-patterns, in which dots are formed by ink drops of the same color at 0.5- to 2.5-mm intervals, should preferably be stored on a storage medium together with a computer program for allowing the printing device to operate in the aforementioned sequence.

The following procedure should preferably be adopted when the adjustment values are values designed to reduce dot formation misalignments in the direction of main scanning during a printing process in which ink drops are deposited and dots are formed on a print medium while main scanning is performed in opposite directions. In the printing of the second misalignment verification pattern, the second sub-patterns may preferably be printed in forward and reverse passes of the main scan. With this approach, a second adjustment value can be set based on second sub-patterns that reflect the attributes of dot formation misalignments in the forward and reverse passes of a main scan.

The following procedure should preferably be adopted when the printing device carries out printing process performing sub-scans between main scans, wherein the plurality of single-color nozzle groups and/or the print medium is moved in a direction that intersects the direction of main scanning in the sub-scan. In the printing of the second misalignment verification pattern, the second sub-patterns may preferably be formed while performing sub-scanning between main scans according to a repeating pattern of sub-scanning feed amounts performed between the main scans during image printing. With this approach, a second adjustment value can be selected based on a color patch with the same properties as those of the print results obtained during actual printing.

The following procedure should preferably be adopted when the plurality of single-color nozzle group comprises a plurality of single chromatic color nozzle groups for ejecting single chromatic color inks. In the printing of the second sub-pattern, the second sub-patterns may preferably be formed using two or more of the single chromatic color nozzle groups. With this approach, a second adjustment value capable of providing higher picture quality can be selected in an efficient manner in cases in which colors are formed on a print medium from a plurality of chromatic-color inks.

The following procedure should preferably be adopted when the plurality of single-color nozzle groups further comprises a single achromatic color nozzle group for ejecting single achromatic color ink. In the printing of the first misalignment verification pattern, the first misalignment verification pattern may preferably be formed using the single achromatic color nozzle group. The first adjustment value may be stored as a value for a first print mode using only the single achromatic color nozzle group. The second adjustment value may be formed as a value for a second print mode using at least one of the single chromatic color nozzle groups. Adopting this approach allows dot formation misalignments to be adjusted on the basis of a first adjustment value optimized for single achromatic color nozzle groups in the first print mode, and dot formation misalignments to be adjusted on the basis of a second adjustment value selected based on single chromatic color nozzle groups in the second print mode.

The following approach can be adopted. In setting of the first adjustment value, the first misalignment verification pattern may be formed on a print mediumsuch that the first misalignment verification pattern contains a plurality of first sub-patterns associated with the first possible adjustment values, respectively, each first sub-pattern having a first ruled line whose direction intersects the direction of main scanning, and also having a second ruled line associated with the first ruled lines and oriented in a direction that intersects the direction of main scanning. Then the first adjustment value may be set in accordance with correction information about a preferred corrected state selected from the first misalignment verification pattern. In setting of the second adjustment value, the second misalignment verification pattern may be formed on a print medium such that the second misalignment verification pattern contains a plurality of second sub-patterns reproduced as uniform color patches and associated with the second adjustment values, respectively. Then the second adjustment value may be set in accordance with correction information about a preferred corrected state selected from the second misalignment verification pattern.

In the printing of the second misalignment verification pattern, the second sub-patterns may preferably be formed associated with the plurality of second possible adjustment values whose difference is equal to a difference between the plurality of first possible adjustment values. Adopting this approach makes it possible to set the first and second adjustment values with equal accuracy.

The following procedure should preferably be adopted when the plurality of single-color nozzle groups comprise a single achromatic color nozzle group for ejecting single achromatic color ink, and a plurality of single chromatic color nozzle groups for ejecting the corresponding single chromatic color inks. In the printing of the first misalignment verification pattern, the first misalignment verification pattern may be formed using the single achromatic color nozzle group. In the printing of the second misalignment verification pattern, the second sub-patterns may be formed using two or more of the single chromatic color nozzle groups. The first adjustment value may be stored as a value for a first print mode using only the single achromatic color nozzle group. The second adjustment value may be stored as a value for a second print mode using at least one of the single chromatic color nozzle groups.

Adopting this approach allows dot formation misalignments to be adjusted on the basis of a first adjustment value optimized for single achromatic color nozzle groups in the first print mode, and dot formation misalignments to be adjusted on the basis of a second adjustment value selected based on single chromatic color nozzle groups in the second print mode. The dot formation misalignments can be adjusted with equal accuracy in the first and second print modes.

It is preferable that the control unit of the printing device further comprises a determination unit configured to determine whether printing is performed according to the first or second print mode on the basis of a print data input. The images are printed on the basis of the decision made by the determination unit. Adopting this approach allows the system to automatically adjust itself on the basis of first and second adjustment values without waiting for user input.

The present invention can be implemented as the following embodiments.

(1) Adjustment value determination methods, printing methods, and printing control methods.

(2) Printing devices and print control devices.

(3) Computer programs for operating such devices or performing such methods.

(4) Storage media containing computer programs for operating such devices or performing such methods.

(5) Data signals having the form of carrier waves and containing computer programs for operating such devices or performing such methods.

DESCRIPTION OF THE PREFERRED EMBODIMENTS

Embodiments of the present invention will now be described through embodiments in the following sequence.

A. Device Structure

B. Occurrence of Recording Misalignment Among Nozzle Rows

C. First Embodiment

D. Second Embodiment

E. Third Embodiment

F. Modifications

A. Device Structure

Figure 1:
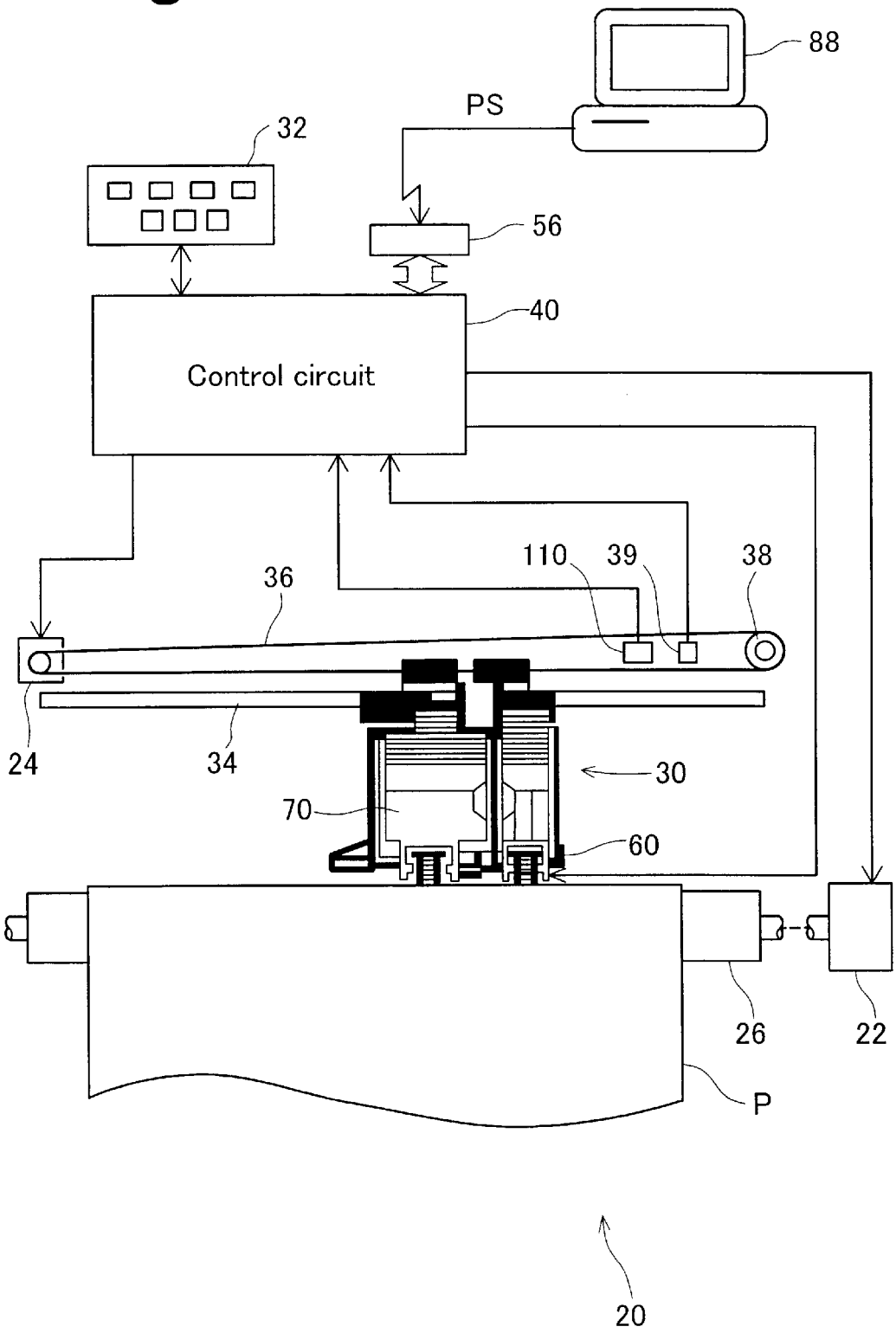
FIG. 1 is a is a schematic block diagram of a printing system equipped with the printer 20 of the first embodiment.

FIG. 1 is a schematic block diagram of a printing system equipped with an ink-jet printer 20 as a embodiment of the present invention. The color printer 20 comprises a sub-scanning mechanism for transporting printing paper P in the direction of sub-scanning by means of a paper feed motor 22, a main scanning mechanism for reciprocating a carriage 30 in the axial direction (direction of main scanning) of a platen 26 by means of a carriage motor 24, a head drive mechanism for ejecting ink and forming dots by actuating a print head unit 60 (occasionally referred to as "a print head assembly") mounted on the carriage 30, and a control circuit 40 for exchanging signals among the paper feed motor 22, the carriage motor 24, the print head unit 60, and a control panel 32. The control circuit 40 is connected by a connector 56 to the computer 88.

The sub-scanning mechanism for transporting the printing paper P comprises a gear train (not shown) for transmitting the rotation of the paper feed motor 22 to the platen 26 and the roller (not shown) for transporting the printing paper. The main scanning mechanism for reciprocating the carriage 30 comprises a sliding shaft 34 mounted parallel to the axis of the platen 26 and designed to slidably support the carriage 30, a pulley 38 for extending an endless drive belt 36 from the carriage motor 24, and a position sensor 39 for sensing the original position of the carriage 30.

Figure 2:
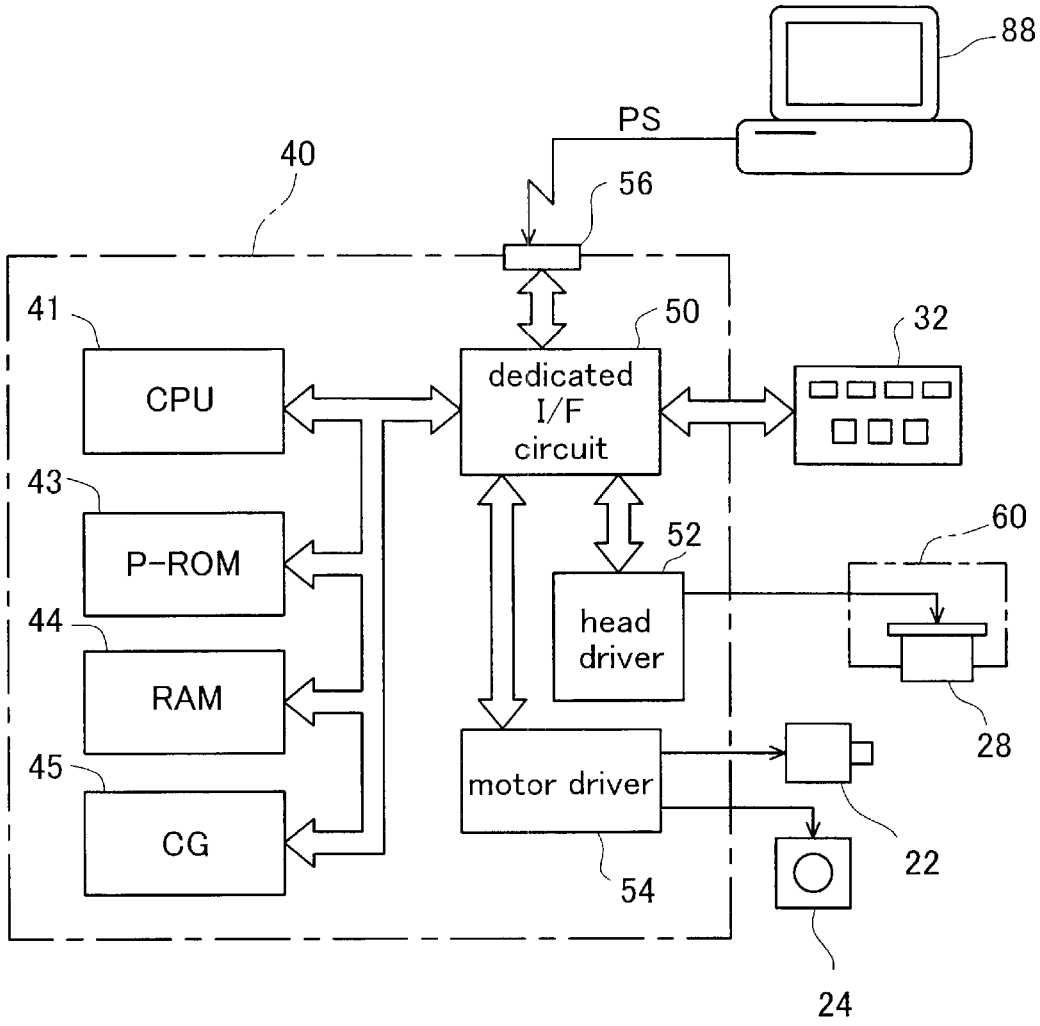
FIG. 2 is a block diagram depicting the structure of the control circuit 40 in the printer 20.

FIG. 2 is a block diagram depicting the structure of a printer 20 based on the control circuit 40. The control circuit 40 is designed as an arithmetic logical circuit comprising a CPU 41, a programmable ROM (PROM) 43, a RAM 44, and a character generator (CG) 45 containing dot matrices for characters. The control circuit 40 further comprises a dedicated I/F circuit 50 for providing an interface with external motors and the like, a head drive circuit 52 connected to the dedicated I/F circuit 50 and designed to eject ink by actuating the print head unit 60, and a motor drive circuit 54 for actuating the paper feed motor 22 and carriage motor 24. The dedicated I/F circuit 50 contains a parallel interface circuit and is capable of receiving print signals PS from the computer 88 via the connector 56.

There is also provided a print head 28, which comprises a plurality of nozzles n arranged in rows by color, and an actuator circuit 90 for actuating the piezoelements PE provided to the nozzles n. The actuator circuit 90 is part of the head drive circuit 52 (see FIG. 2) and is designed to controllably switch on and off drive signals received from a drive signal generating circuit (not shown) inside the head drive circuit 52. Specifically, the actuator circuit 90 latches the data that specify the "on" (ink ejected) or "off" (no ink ejected) state of each nozzle in accordance with a print signal PS received from the computer 88, and provides drive signals solely to the piezoelements PE whose nozzles are on.

Figure 3:
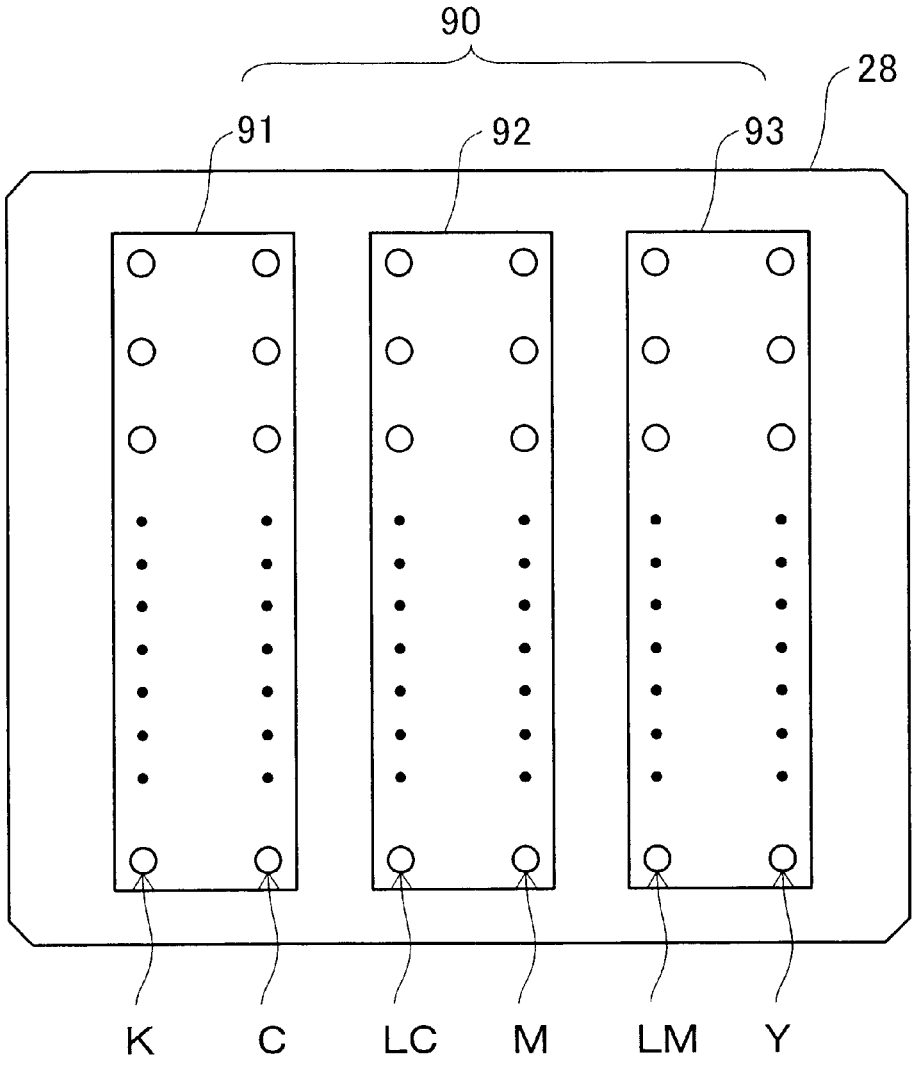
FIG. 3 is a diagram depicting the relation between the plurality of actuator chips and the plurality of nozzle rows in a print head 28.

FIG. 3 is a diagram depicting the relation between the plurality of actuator chips and the plurality of nozzle rows in the print head 28. The printer 20 is a printing device in which printing is carried out using inks of the following six colors: black (K), dark cyan (C), light cyan (LC), dark magenta (M), light magenta (LM), and yellow (Y). The printer is provided with a row of nozzles for each ink. Dark cyan and light cyan are cyan inks with substantially the same hues but different densities. The same applies to dark magenta and light magenta. Each nozzle row corresponds to the single-color nozzle group referred to in the claims. In addition, the black nozzle row (K) corresponds to the single achromatic color nozzle group referred to in the claims, and the other nozzle rows correspond to the single chromatic color nozzle groups.

The actuator circuit 90 comprises a first actuator chip 91 for actuating the black nozzle row K and dark cyan nozzle row C, a second actuator chip 92 for actuating the light cyan nozzle row LC and the dark magenta nozzle row M, and a third actuator chip 93 for actuating the light magenta nozzle row LM and the yellow nozzle row Y.

B. Occurrence of Recording Misalignment Among Nozzle Rows

A recording misalignment occurring during bidirectional printing is adjusted in accordance with the first embodiment described below. The occurrence of a recording misalignment during bidirectional printing will be described herein before the first embodiment is described.

Figure 4A:
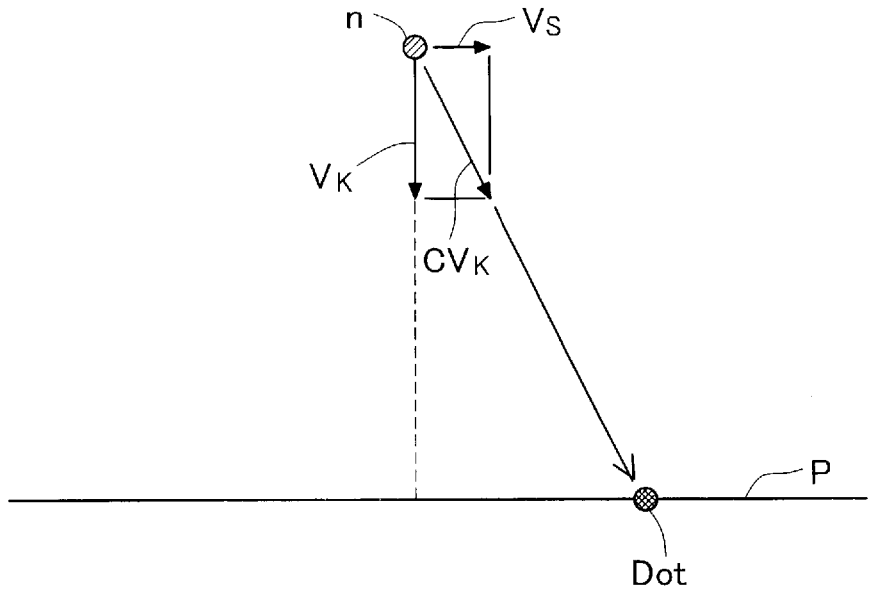
FIGS. 4*a* and 4*b* are diagrams depicting a misalignment occurring during bidirectional printing.
Figure 4B:
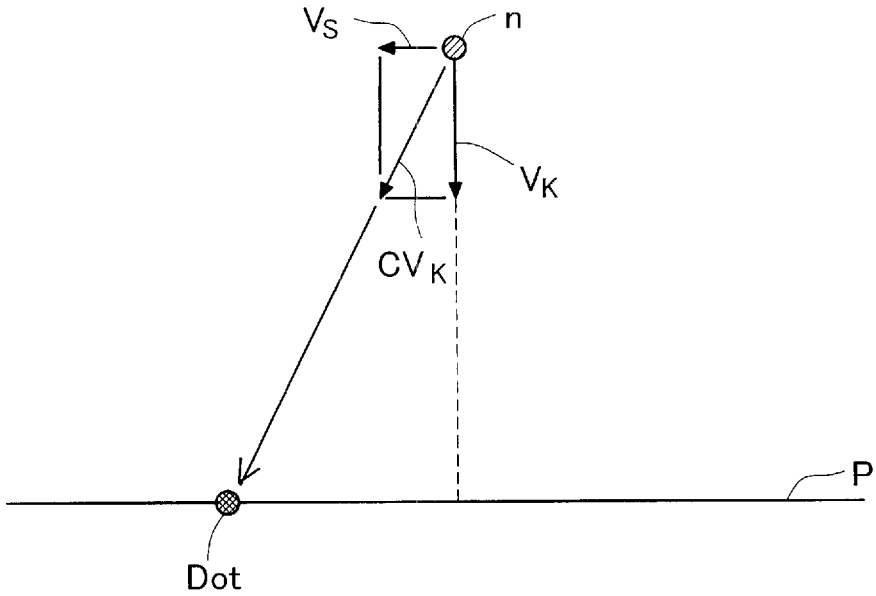

FIGS. 4*a* and 4*b* illustrate misalignment occurring during bidirectional printing. FIG. 4*a* depicts an impact position occupied by a dot in a forward pass during printing, and FIG. 4*b* depicts an impact position occupied by a dot in a reverse pass during printing. The nozzle n forms dots on the printing paper P by moving horizontally in opposite directions over the printing paper P and ejecting ink in the forward and reverse passes. It is assumed that the ink is ejected vertically downward at an ejection velocity Vk. The combined velocity vector CVk of each ink is obtained by combining the downward ejection velocity vector and the main scan velocity vector Vs of nozzle n. Consequently, the positions at which an ink drops strike the print medium are misaligned when the ink drops are ejected while the printing paper P and the print head 28 are in the same relative position in the forward and reverse passes during main scanning. It is therefore necessary to adjust the timing with which the ink drops are ejected in the forward and reverse passes during main scanning to align the positions at which the ink drops strike the print medium.

In FIGS. 4*a* and 4*b*, the dot formation positions in the forward and reverse passes are substantially symmetrical in relation to the position of the nozzle at the time of ejecting an ink drop. However, there are also factors that act to prevent the dot formation positions in the forward and reverse passes to be completely symmetrical, such as the backlash of the drive mechanism in the direction of main scanning and the warping of the platen that supports the print medium from below. The timing with which ink drops are ejected in the forward and reverse passes during main scanning should preferably be adjusted in order to absorb the dot formation misalignment caused by these factors.

C. First Embodiment

Figure 5:
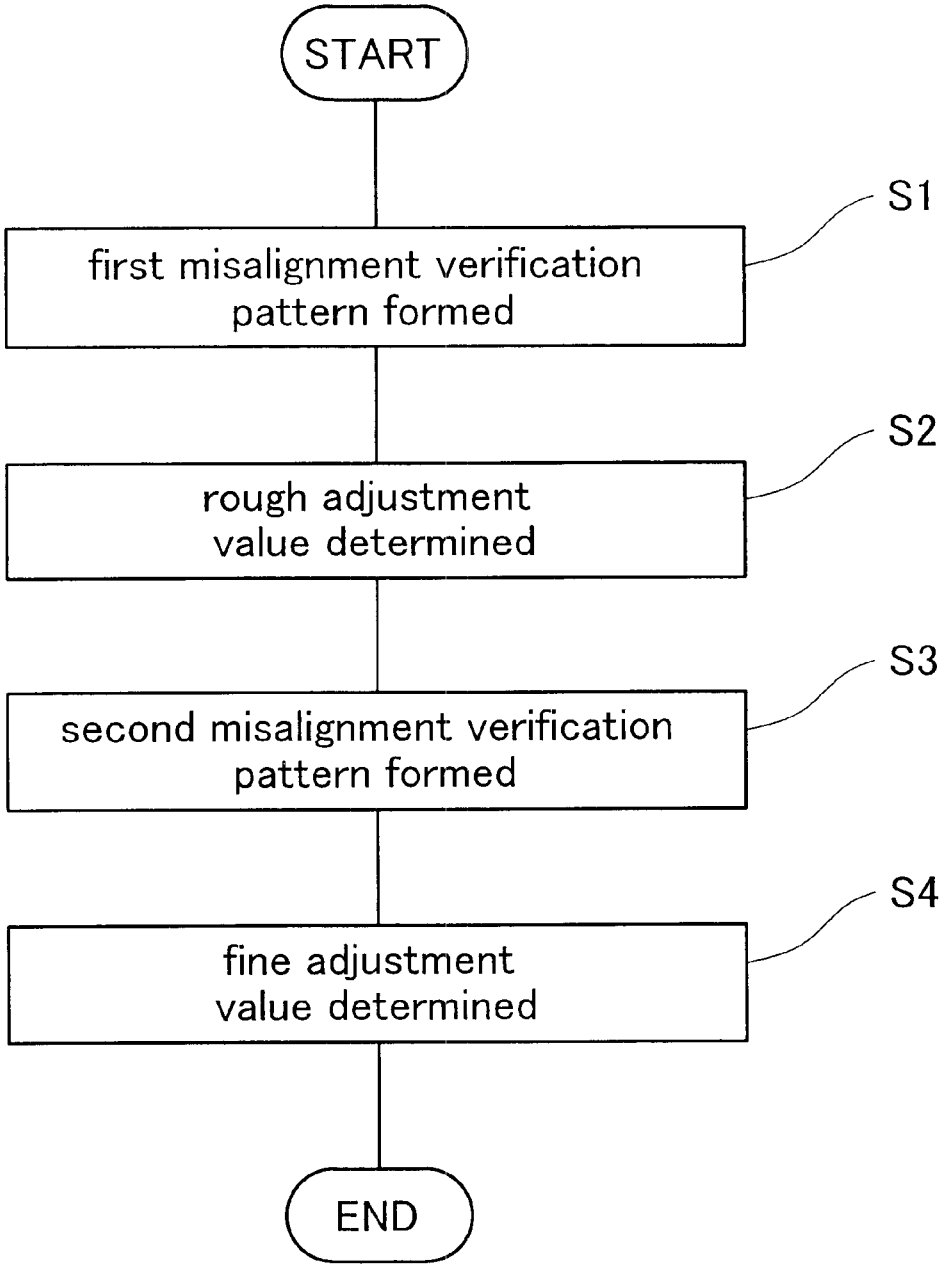
FIG. 5 is a flowchart depicting the entire routine performed in accordance with the first embodiment of the present invention.

FIG. 5 is a flowchart depicting the entire routine performed in accordance with the first embodiment of the present invention. In step S1, a first misalignment verification pattern is formed. In step S2, the operator determines a rough adjustment value on the basis of the first misalignment verification pattern and enters the determination information into the printer 20. In step S3, a second misalignment verification pattern is formed on the basis of the rough adjustment value. In step S4, the operator determines a fine adjustment value on the basis of the second misalignment verification pattern and enters the determination information into the printer 20. A detailed description of each step follows. The rough adjustment value corresponds to the first adjustment value referred to in the claims, and the fine adjustment value corresponds to the second adjustment value referred to in the claims.

Figure 6:
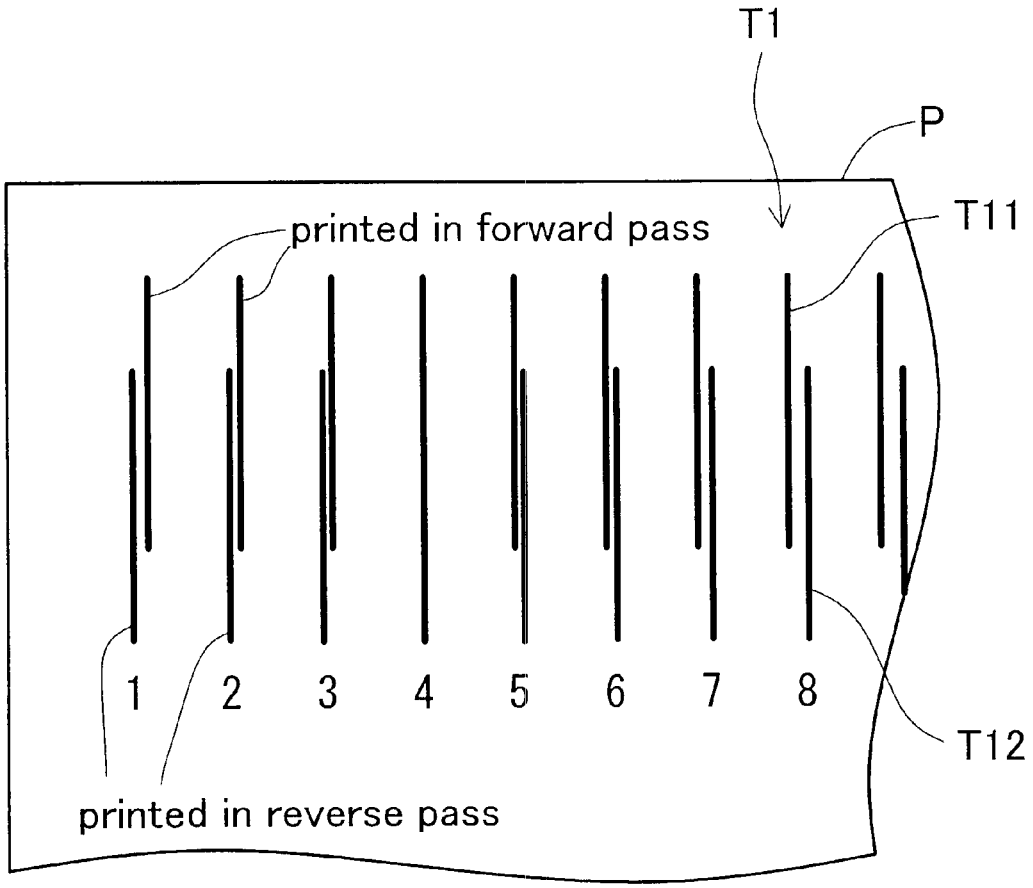
FIG. 6 is a diagram depicting an example of a first misalignment verification pattern, which is used to determine a rough adjustment value.

FIG. 6 is a diagram depicting an example of the first misalignment verification pattern used to determine a rough adjustment value. In step S1, the first misalignment verification pattern used to determine a rough adjustment value is printed by printer 20. The first misalignment verification pattern is composed of a plurality of vertical ruled lines printed in the forward and reverse passes by the black nozzle row K (see FIG. 3). Vertical ruled lines T11 are recorded at regular intervals in the forward passes, whereas vertical ruled lines T12 are recorded in the reverse passes such that their positions in the main scanning direction are gradually shifted in 1/1440-inch increments. As a result, a plurality of vertical ruled line pairs T1 are printed on the printing paper P such that there is a shift of 1/1440 inch between the relative positions of the vertical ruled lines T11 in the forward pass and the vertical ruled lines T12 in the reverse pass. The vertical ruled line pairs T1 constitute the first sub-pattern referred to in the claims. The vertical ruled lines T11 of the forward pass are referred to as "the first ruled lines," and the vertical ruled lines T12 of the reverse pass are referred to as "the second ruled lines." The shift amount of ruled lines in each pair corresponds to a first possible adjustment value. Numerals designating shift adjustment numbers are printed below the plurality of groups of vertical ruled line pairs T1. The shift adjustment numbers function as correction-related information about the preferred corrected state. As used herein, the term "preferred corrected state" refers to a state in which the positions (in the direction of main scanning) of dots formed in the forward and reverse passes are substantially aligned with each other when the recording positions (or recording timings) in the forward and reverse passes are corrected with appropriate rough adjustment values. In the example presented in FIG. 6, the vertical ruled line pair whose shift adjustment number is 4 is in the preferred corrected state. The CPU 41 prints the first misalignment verification pattern on the basis of data received from the computer 88 by controlling each unit. In other words, the CPU 41 corresponds to the first pattern formation unit referred to in the claims.

In step S2, the user investigates the first misalignment verification pattern, selects the vertical ruled line pair that has the smallest shift, and sends the corresponding shift adjustment number to the user interface screen (not shown) of the printer driver on the computer 88 (see FIG. 2). The shift adjustment number is stored in the PROM 43 in the printer 20. The shift value associated with the shift adjustment number stored in the PROM 43 is the first adjustment value referred to in the claims. In addition, the input device (keyboard, mouse, microphone, or the like) of the computer 88 corresponds to the input unit referred to in the claims, and the below-described adjustment number storage area 202*a* of the PROM 43 corresponds to a first adjustment value storage unit. The shift adjustment number may also be entered via the control panel 32 (see FIG. 2). In this case, the control panel 32 corresponds to the input unit.

Figure 7:
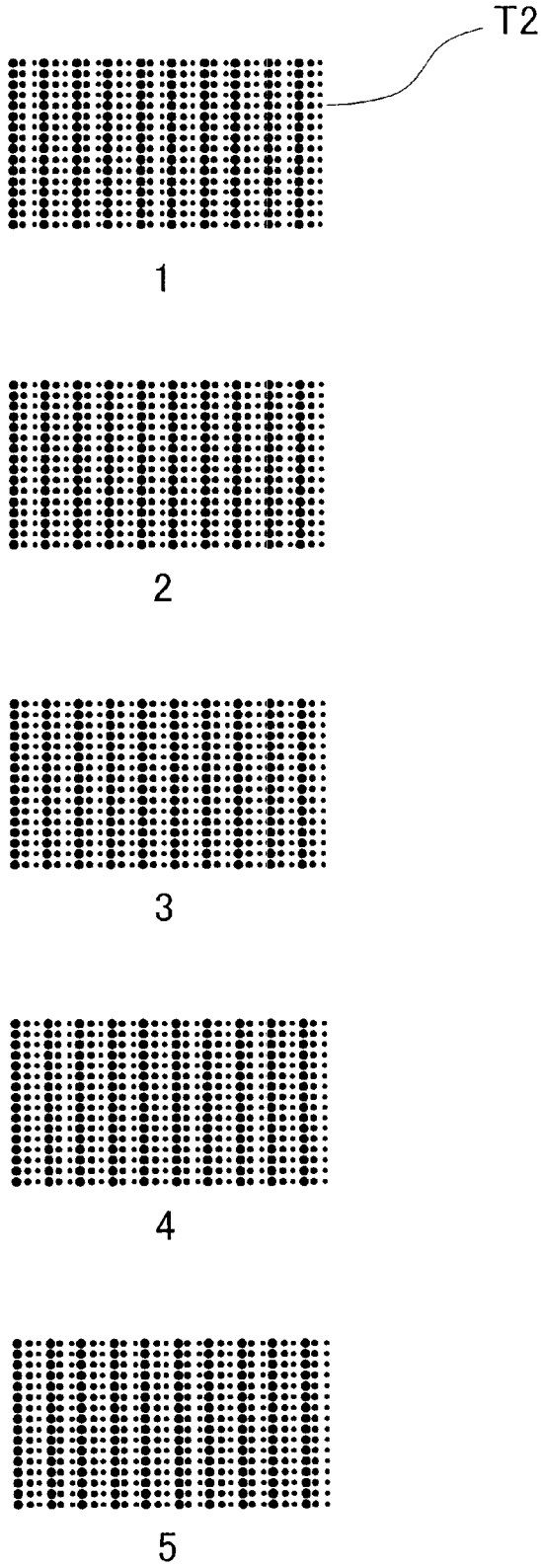
FIG. 7 is a schematic depicting an example of a second misalignment verification pattern, which is used to determine a fine adjustment value.

FIG. 7 depicts an example of the second misalignment verification pattern, which is used to determine a fine adjustment value. In step S3 (see FIG. 1), the second misalignment verification pattern used to determine a fine adjustment value is printed by printer 20. The second misalignment verification pattern is composed of a plurality of gray patches T2 printed using light cyan, light magenta, and yellow nozzle rows on both the forward pass and the reverse pass. The gray patches T2 correspond to the second sub-pattern referred to in the claims. Although a comparatively large dot assembly is depicted for each of the patches T2 in FIG. 7, in practice the patches are formed from visually indistinguishable individual dots. The word "gray" in the term "gray patch" does not mean that the patch always appears to the human eye as having a gray color. The patch may appear to have any color as long as it is formed using two or more chromatic color inks.

The dots of each color constituting each patch are recorded at specific positions in the direction of main scanning in the forward passes for each patch. In the case of the reverse pass, the dots are recorded such that their positions in the direction of main scanning are gradually shifted at $1/2880$-inch increments from patch to patch. The dots of each color constituting each patch are shifted by a common value from patch to patch. As a result, a plurality of gray patches T2 are printed on the printing paper P such that each patch has a shift, from the previous patch, of $1/2880$ inch between the relative positions of the dots formed in the forward pass and the dots formed in the reverse pass. The shift amount of each gray patch T2 in the forward and reverse passes corresponds to the second possible adjustment value referred to in the claims. Numerals designating shift adjustment numbers are printed below the plurality of gray patches T2, as shown in FIG. 7. The shift adjustment numbers function as correction-related information about the preferred corrected state. As used herein, the term "preferred corrected state" refers to a state in which the graininess of the gray patches T2 is minimized when the recording positions (or recording timings) in the forward and reverse passes are corrected with appropriate fine adjustment values. The preferred corrected condition can therefore be expressed by such appropriate fine adjustment values.

The fine adjustment value of the central patch labeled by the numeral 3 in FIG. 7 is equal to the rough adjustment value of the fourth ruled line pair selected in FIG. 6. Specifically, shift values (second possible adjustment values) forthe gray patches T2 contain a particular fine adjustment value that is equal to the rough adjustment value selected in step S2 (see FIG. 1), and also contain a plurality of values which are sequentially shifted in $1/2880$-inch increments toward larger and smaller values from the particular fine adjustment value. Such shift values are set by the CPU 41 on the basis of the rough adjustment values entered. In other words, the CPU 41 corresponds to the second possible adjustment value-setting unit referred to in the claims. The example shown in FIG. 7 depicts five gray patches provided with shift adjustment numbers of 1 to 5 and disposed on both sides of the patch labeled by the numeral 3. In FIG. 7, the gray patch labeled by the shift adjustment number 4 indicates a preferred corrected state with the least pronounced graininess.

The data concerning gray patches are obtained by converting image data representing a uniform dense patch to a binary data format in which images are represented depending on the presence or absence of dots whose ink colors are used during the printing of the second misalignment verification pattern. These data are stored on the hard disk (storage unit) in the computer 88. Each gray patch is printed as the sub-scanning feed pattern performed during actual printing in step S3. An example will now be described with reference to a pattern for sub-scan feeding.

Figure 8A:
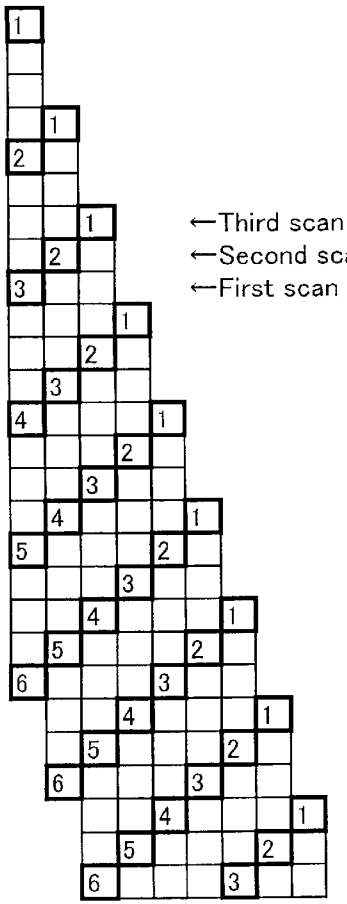
FIGS. 8*a* and 8*b* are diagrams depicting a comparison between sub-scanning at a constant feed amount and sub-scanning at a non-constant feed amount.
Figure 8B:
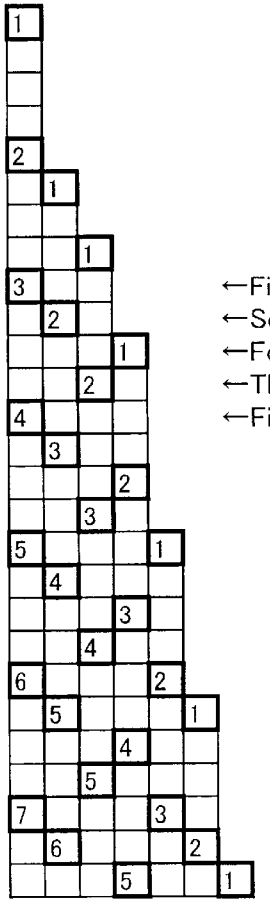

FIGS. 8*a* and 8*b* are diagrams depicting a comparison between sub-scanning at a constant feed amount and sub-scanning at a non-constant feed amount. "Sub-scanning" is an operation in which a print medium and/or print head equipped with nozzle groups is caused to move in a direction that intersects the direction of main scanning. In addition, "non-constant feeding" refers to a method of deeding during sub-scanning in which a plurality of different feed amounts are combined and used. Performing printing by conducting sub-scanning in the intervals between main scanning passes allows images that extend in the direction perpendicular to the direction of main scanning to be printed on a print medium. In FIGS. 5*a* and 8*b*, for example, the caption "first scan" indicates the raster lines recorded by a first main scan pass, and the caption "second scan" indicates the raster lines recorded by a second main scan pass that follows the first sub-scan pass. The terms "raster line" refers to pixels arranged in a row in the direction of main scanning. The term "pixel" refers to a square of an imaginary grid drawn on a print medium in order to define the positions at which dots are to be recorded on the print medium. When sub-scanning is performed at a constant feed amount, the raster line adjacent to the raster line targeted for recording during a preceding main scan pass is always targeted for recording during the subsequent main scan pass, as shown in FIG. 8*a*. In the case of non-constant feeding, a raster line that is not adjacent to the raster line targeted for recording during a preceding main scan pass is occasionally targeted for recording during a subsequent main scan pass, as illustrated for the second and third scan passes in FIG. 8*b*. The following two problems may be encountered when adjacent raster lines are constantly targeted for recording in the manner shown in FIG. 8*a*. the first problem is that smudge is apt to occur between the dots. The second problem is that mechanical feed errors related to sub-scanning gradually accumulate, resulting in a significant misalignment between any two adjacent raster lines. Both these problems are factors that degrade picture quality. Using non-constant feeding can address these problems and ultimately produce a result that allows picture quality to be improved.

Although a variety of sub-scanning feed patterns can be obtained in this manner, the second misalignment verification pattern shown in FIG. 7 is printed in accordance with the sub-scanning feed pattern used in the printing of actual images. The CPU 41 prints the second misalignment verification pattern on the basis of data received from the computer 88 by controlling each unit. In other words, the CPU 41 corresponds to the second pattern formation unit referred to in the claims.

In step S4 (see FIG. 5), the user analyzes a test pattern printed in the manner shown in FIG. 7 and sends the shift adjustment number of a gray patch with the least pronounced graininess to the user interface screen (not shown) of the printer driver on the computer 88 (see FIG. 2). The shift adjustment number is stored in the PROM 43 in the printer 20. The shift value associated with the shift adjustment number stored in the PROM 43 is the second adjustment value referred to in the claims. In addition, the input device (keyboard, mouse, microphone, or the like) of the computer 88 corresponds to the input unit referred to in the claims, and the below-described adjustment number storage area 202*b* of the PROM 43 corresponds to a second adjustment value storage unit. The shift adjustment number may also be entered via the control panel 32 (see FIG. 2) in the same manner as when a rough adjustment value is determined. In this case, the control panel 32 corresponds to the input unit. When printing is performed by the user after a shift adjustment number associated with a fine adjustment value has been stored in the PROM 43, bidirectional printing is carried out while the shifting is corrected using the fine adjustment value.

Figure 9:
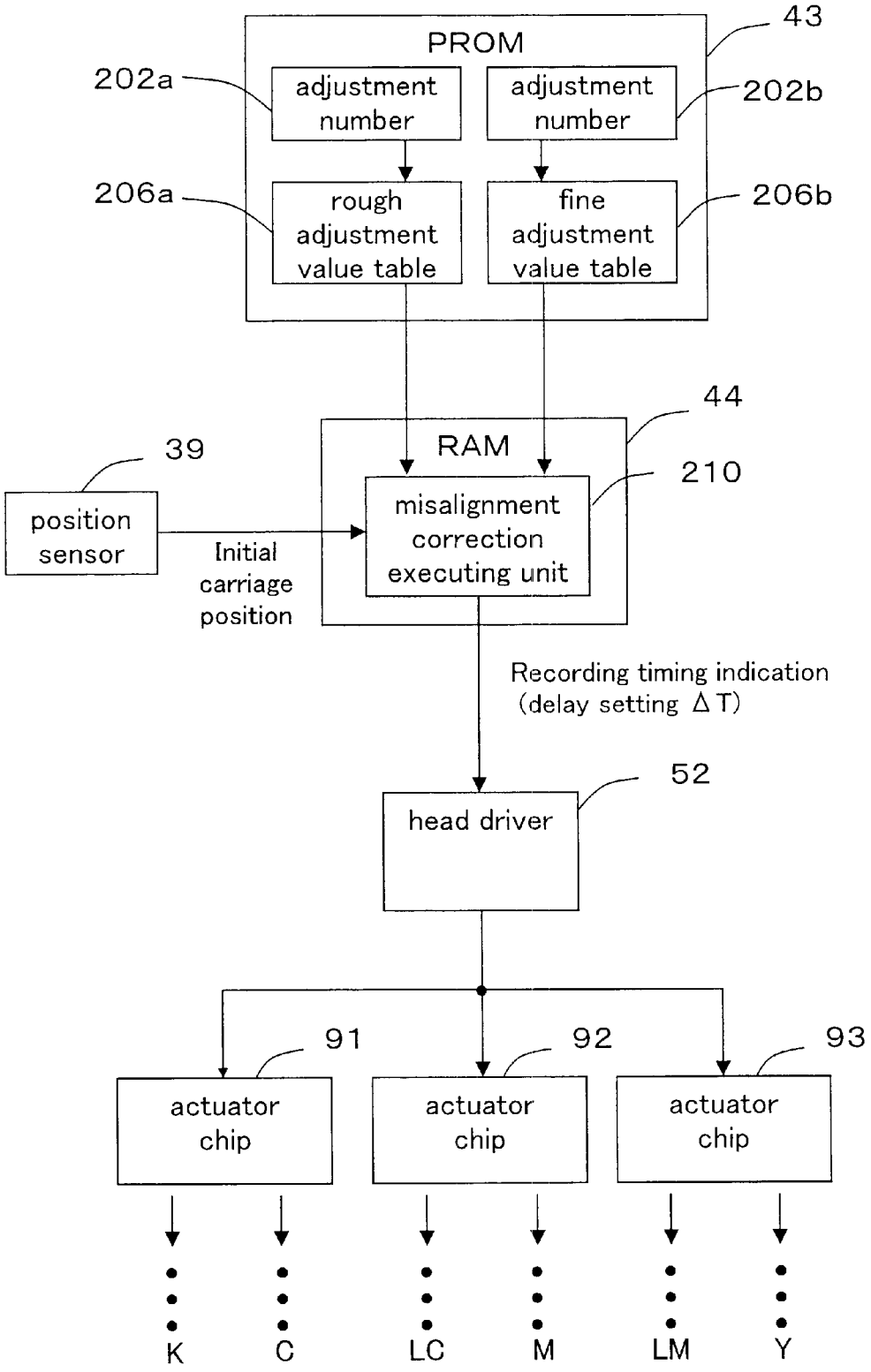
FIG. 9 is a block diagram depicting parts of a structure whereby any shifting occurring during bidirectional printing is corrected in accordance with the first embodiment.

FIG. 9 is a block diagram depicting parts of a structure for misalignment correction during bidirectional printing in accordance with the first embodiment. The PROM 43 of the printer 20 comprises the adjustment number storage areas 202*a* and 202*b*, a rough adjustment value table 206*a*, and a fine adjustment value table 206*b*.

A shift adjustment number that expresses the preferred rough adjustment value is stored in the adjustment number storage area 202*a*. The rough adjustment value table 206*a* is a table for expressing the relation between the rough adjustment values and the shift adjustment numbers in FIG. 6. The rough adjustment value table 206*a* stores the relation between the shift adjustment numbers and the extent (that is, the rough adjustment values) to which the vertical ruled lines of a reverse pass are shifted in terms of recording position in the first misalignment verification pattern shown in FIG. 6.

A shift adjustment number that expresses the preferred fine adjustment value is stored in the adjustment number storage area 202*b*. The fine adjustment value table 206*b* is a table for expressing the relation between the fine adjustment values and the shift adjustment numbers in FIG. 7. The fine adjustment value table 206*b* stores the relation between the shift adjustment numbers and the extent (that is, the fine adjustment values) to which the dot recording positions of the reverse pass are shifted in the second misalignment verification pattern shown in FIG. 7.

Figure 10:
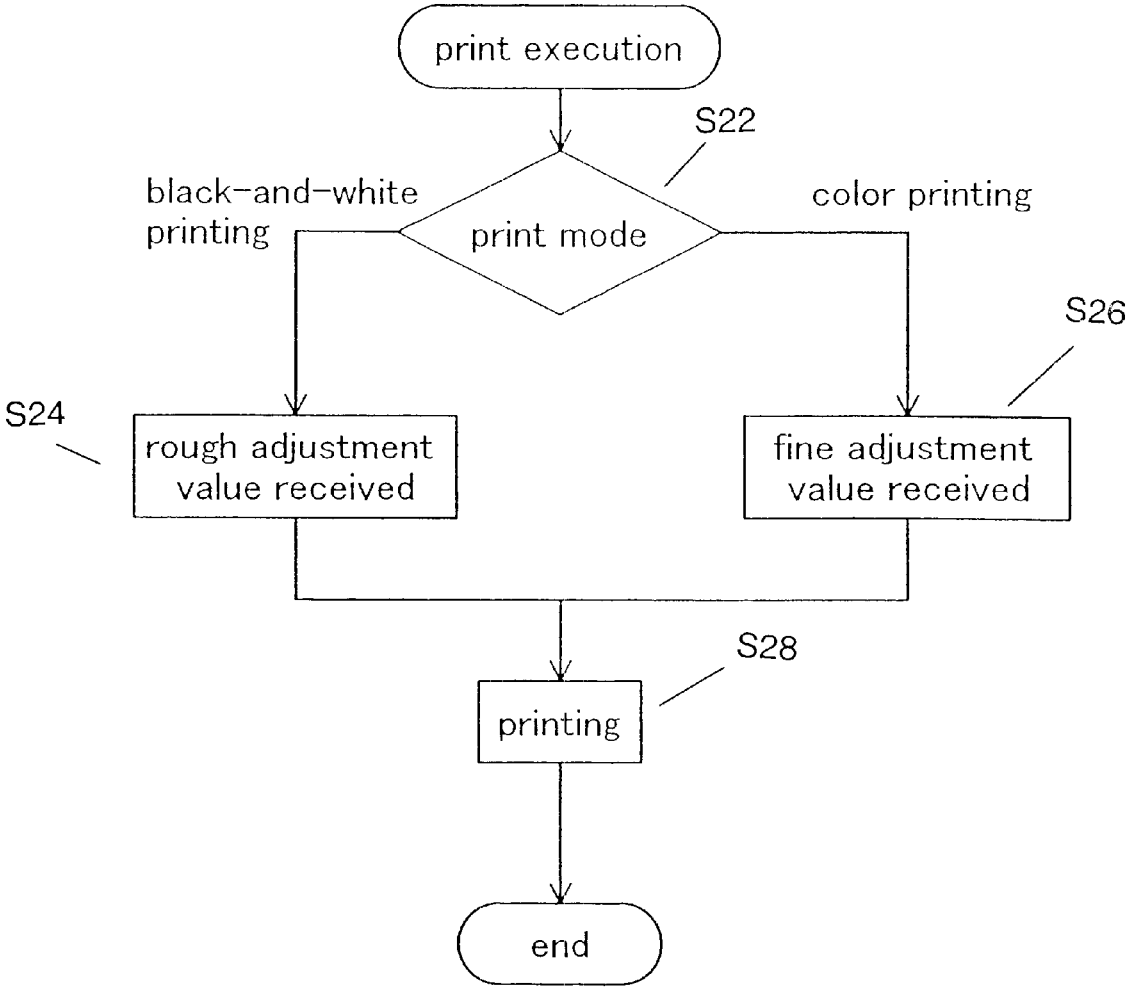
FIG. 10 is a flowchart depicting a processing sequence adopted for determining the adjustment values used to correct a misalignment during bidirectional printing.

FIG. 10 is a flowchart depicting a processing sequence adopted for determining the adjustment values used to correct a misalignment during bidirectional printing. The RAM 44 in the printer 20 stores a computer program which functions as a misalignment correction executing unit 210 to correct misalignments during bidirectional printing. The misalignment correction executing unit 210 receives an adjustment number from the adjustment number storage area 202*a*, and also received the corresponding rough adjustment value from the rough adjustment value table 206*a* in the step S24, when a notification pertaining to black-and-white printing arrives from the computer 88 (see FIG. 1) in the step S22. Specifically, a notification about black-and-white printing or a notification about color printing is transmitted to the printer 20 as a parameter contained in the print data received from the computer 88. The rough adjustment value is the first adjustment value refereed to in the claims. The misalignment correction executing unit 210 presents the head drive circuit 52 with a signal that specifies the recording timing of the head on the basis of rough adjustment value in the step S28. When a notification about color printing is transmitted from the computer 88 (See FIG. 1) in the step S22, the misalignment correction executing unit 210 receives an adjustment number from the adjustment number storage area 202*b*, and a corresponding fine adjustment value is received from the fine adjustment value table 206*b* in the step S26. The head drive circuit 52 is presented with a signal that specifies the recording timing of the head on the basis of the fine adjustment value in the step 528. The mode for performing black-and-white printing is the first print mode referred to in the claims, and the mode for performing color printing is the second print mode referred to in the claims. The misalignment correction executing unit 210 corresponds to "a determination unit", "a first printing unit", or "a second printing unit". Printing performed in accordance with each print mode will now be described.

In the case of color printing, the fine adjustment value table 206*b* is referred to by the misalignment correction executing unit 210, yielding a fine adjustment value that corresponds to an adjustment number stored in the adjustment number storage area 202*b* of the PROM 43. This fine adjustment value is the second adjustment value referred to in the claims. When a signal designating the original position of the carriage 30 in relation to the position sensor 39 (see FIG. 1) in the reverse pass is received, a signal (delay setting $\Delta T$) for defining the recording timing of the head is fed to the head drive circuit 52 by the misalignment correction executing unit 210 in accordance with the fine adjustment value. The head drive circuit 52 feeds the same drive signal to the three actuator chips 91–93 and adjusts the recording position of the reverse pass in accordance with the recording timing (that is, the delay setting $\Delta T$) presented by the misalignment correction executing unit 210. The dot recording positions of six nozzle rows are thus adjusted in the reverse pass at a common correction value.

Since the fine adjustment value is set at an integral multiple of $1/2880$ inch in the direction of main scanning in the above-described manner, the corresponding recording positions (that is, recording timing) can be adjusted in $1/2880$-inch increments in the direction of main scanning. Although the present arrangement is described with reference to a case in which the ruled lines printed in the reverse pass are shifted in $1/2880$-inch increments, the adjustment values can be set at an integral multiple of a smaller unit as long as the dots of each color in each patch T2 (see FIG. 7) are shifted at intervals that correspond to this smaller unit. In other words, correction values can be set within a narrower range if smaller increments are adopted for the shifting between the positions of dots printed in the reverse pass. The minimum increment value is determined by the control limitations of the printer.

When monochromatic images are printed using the black nozzle row alone, the rough adjustment value table 206*a* is read by the misalignment correction executing unit 210, yielding a rough adjustment value that corresponds to an adjustment number stored in the adjustment number storage area 202*a* of the PROM 43. The misalignment correction executing unit 210 presents the head drive circuit 52 with a signal for defining the recording timing of the head in the same manner as when the correction is made with a fine adjustment value. The head drive circuit 52 adjusts the recording positions in the reverse pass in accordance with the recording timing received from the misalignment correction executing unit 210. The dot recording positions of the black nozzle row are thus adjusted with the rough adjustment value in the reverse pass.

Since the rough adjustment value is set at an integral multiple of $1/1440$ inch in the direction of main scanning in the above-described manner, the recording positions (that is, recording timing) of black-and-white printing can be adjusted in $1/1440$-inch increments in the direction of main scanning. The rough adjustment value is set with the aim of minimizing the dot formation misalignment of black dots in the direction of main scanning, making it possible to reduce the dot formation misalignment with high efficiency in the direction of main scanning by adjusting the ejection timing of ink drops with the rough adjustment value during monochromatic printing.

According to the first embodiment, the rough adjustment value is set on the basis of the black nozzle row in the above-described manner, and the fine adjustment value is selected from a plurality of second possible adjustment values whose difference is less than that of the first possible adjustment values lying in the vicinity of the rough adjustment values. Appropriate values can therefore be set without printing large amounts of adjustment patterns even if the fine adjustment value is set using small units.

It is not always easy for the user to visually select the patch with the least pronounced graininess from a large number of gray patches. In addition, it is difficult to compare the graininess of gray patches disposed far from each other. With the first embodiment, however, the preferred patch can be selected relatively easily because a gray patch with the least pronounced graininess is selected from a limited number of gray patches in accordance with the adjustment values adjacent to the predetermined rough adjustment value.

According to the first embodiment, a fine adjustment value is determined by printing gray patches using light cyan, light magenta, and yellow inks, which are commonly used to print halftone areas with a pronounced graininess. It is therefore possible to reduce the graininess of such halftone areas and to markedly improve the picture quality of printed matter.

Gray patches are printed with actual sub-scan feeding which is used in actual color printing. A fine adjustment value capable of reducing the graininess of printed matter can therefore be established during actual color printing.

In addition, a rough adjustment value optimized for black nozzles is used when monochromatic images are printed by the black nozzle row alone. This allows that images can be printed with a minimal misalignment in the dots of the black ink used during monochromatic printing, as well as images with a minimal graininess can be obtained during color printing.

D. Second Embodiment

Although the first embodiment was described above with reference to a case in which dot formation misalignments were adjusted in the forward and reverse passes of bidirectional printing, the present invention can also be applied to adjusting the dot formation misalignment of nozzle pairs during unidirectional printing. For example, errors occur when the actuator chips are manufactured or when the print head is mounted on the carriage. For this reason, the impact positions (dot formation positions) of ink drops vary slightly from nozzle to nozzle when the ink drops are ejected during the same main scan. Any dot formation misalignment occurring in such cases can be adjusted by adopting the arrangement described below.

Figure 11:
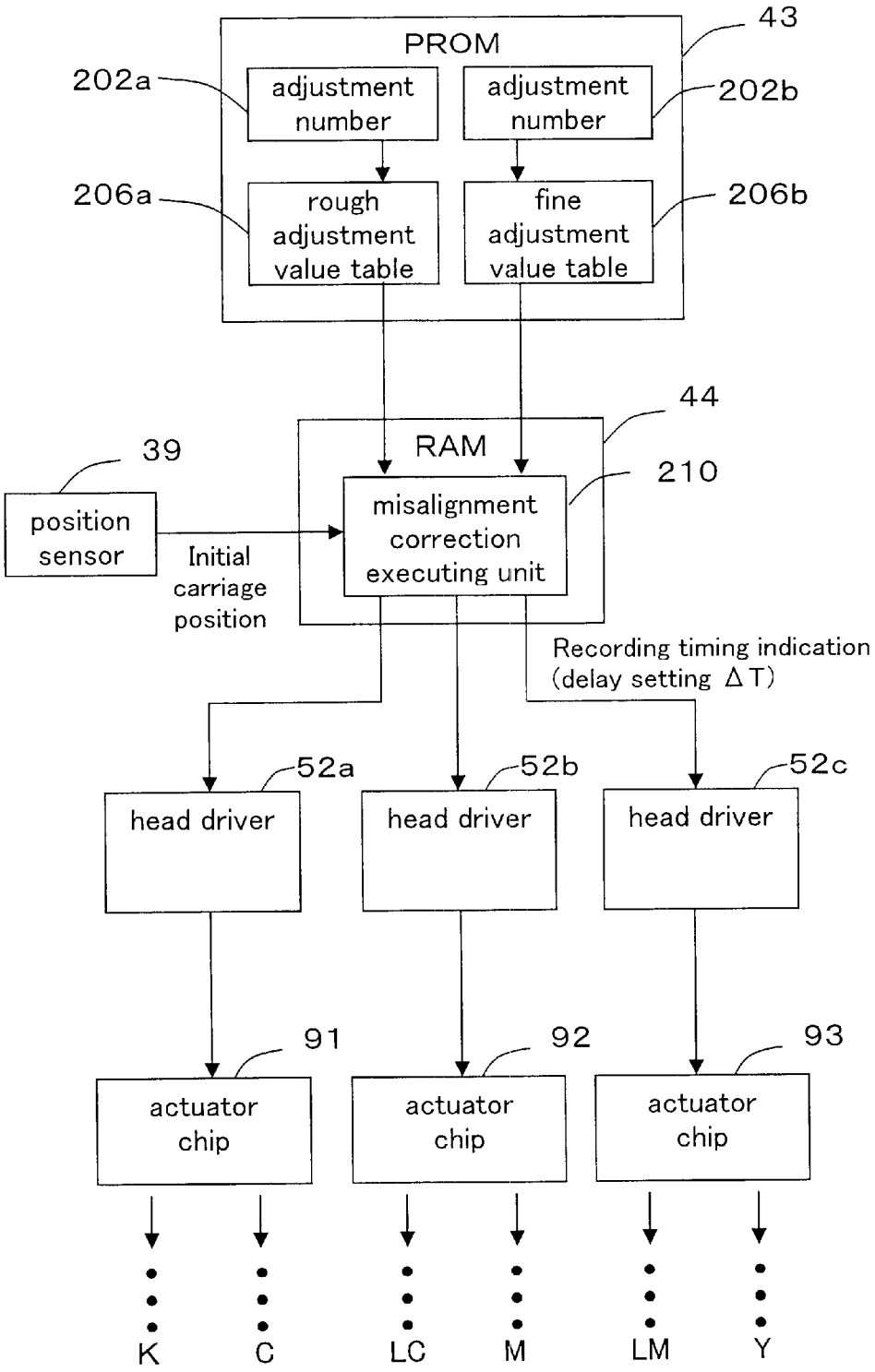
FIG. 11 is a block diagram depicting parts of a structure whereby any shifting occurring during printing is corrected in accordance with a second embodiment.

FIG. 11 is a block diagram depicting parts of a structure whereby any shifting occurring during printing is corrected in accordance with a second embodiment. The structure in this block diagram is the same as that of the block diagram in FIG. 9 except for the structure of the head drive circuit and actuator chips. The printing device of the second embodiment is designed to perform unidirectional printing by ejecting ink drops during a single main scan. The printing device of the second embodiment has an independent head drive circuit 52*c* that is separate from the other actuator chips and is designed for use with an actuator chip 93 for actuating the light cyan and yellow nozzle rows. For this reason, the ejection timing of light magenta and yellow inks can be shifted relative to the inks of other colors. In all other respects this device is identical to the printing device of the first embodiment.

Figure 12:
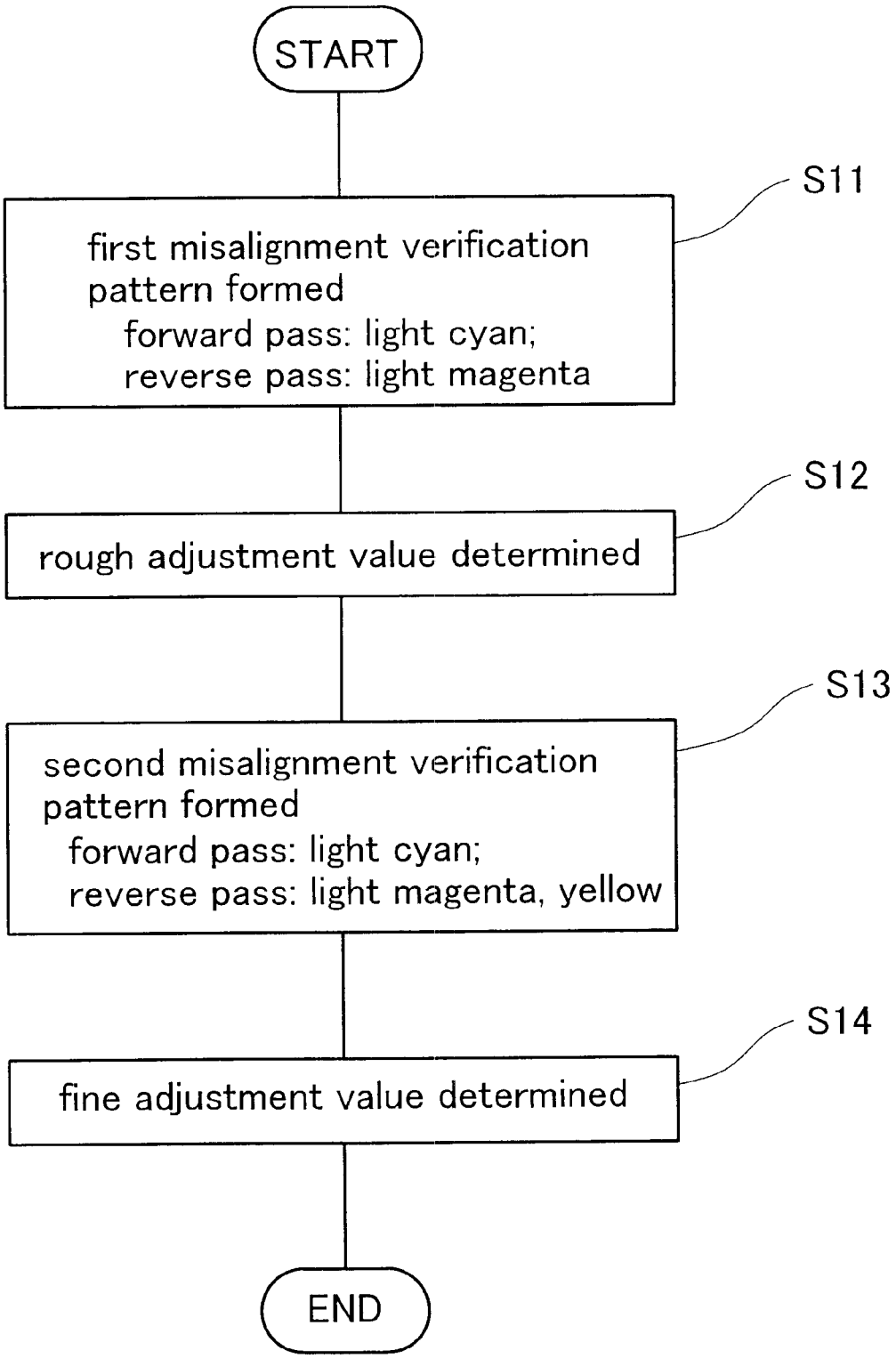
FIG. 12 is a flowchart depicting the entire procedure involved in the second embodiment.

FIG. 12 is a flowchart depicting the entire procedure involved in the second embodiment. A first misalignment verification pattern is formed in step S11. In the process, upper vertical ruled lines (T11 in FIG. 6) are first formed at regular intervals by making use of the light cyan nozzle row. Lower vertical ruled lines (T12 in FIG. 6) are formed while gradually shifted in 1/1440-inch increments by the use of the light magenta nozzle row. Since the printing device of the second embodiment is designed for unidirectional printing, the vertical ruled lines are always formed during identically oriented main scans. In step S12, the operator provides the printer 20 with the adjustment number of the most closely matching vertical ruled line pairs. Rough adjustment values are thus determined.

In step S13, a second misalignment verification pattern is formed based on the rough adjustment values. The gray patches of the second misalignment verification pattern are formed using light cyan, light magenta, and yellow inks in the same manner as in the first embodiment. It should be noted, however, that whereas the light cyan dots constituting each patch are recorded at constant positions within the patch in the direction of main scanning, the light magenta and yellow dots are recorded while their positions in the direction of main scanning are gradually shifted in 1/2880-inch increments from patch to patch. The light magenta and yellow dots are shifted by a common value from patch to patch. The light magenta and yellow nozzle rows are actuated by the common actuator chip 93, and the actuator chip 93 has an independently operating head drive circuit 52*c*. For this reason, light magenta and yellow dots can be shifted relative to light cyan dots in the above-described manner. In the subsequent step S14, the operator provides the printer 20 with the adjustment number of the patches having the least pronounced grainy feel. Fine adjustment values are thus determined.

The misalignment correction executing unit 210 (see FIG. 11) receives adjustment number from the adjustment number storage area 202*b*, and also receives the corresponding fine adjustment values from the fine adjustment value table 206*b* during color printing. The head drive circuit 52*c* is provided with signals for identifying the recording timing of the head on the basis of the fine adjustment values. The head drive circuits for actuating the other nozzle rows does not receive any signals for correcting the dot formation positions. As a result, the positions at which light cyan and yellow dots are formed are adjusted in relation to the dots of other colors. Adopting such an arrangement makes it possible to adjust the dot formation misalignment between nozzles during unidirectional printing.

E. Third Embodiment

FIG. 13 is a diagram depicting an example of a dot arrangement constituting a gray patch T2. A third embodiment will now be described in detail with reference to an example of the structure used for the gray patch T2. The printer of the third embodiment has the same hardware structure as the printer used in the first embodiment. In the third embodiment, a pattern (such as the one shown in FIG. 13) in which dots are arranged in a regular manner in the directions of main scanning and sub-scanning is printed as the gray patch T2 (referred to as "test pattern" throughout the description of the third embodiment given below). FIG. 13 is designed to schematically depict dot arrangements and does not reflect the number or size of dots in an actual gray patch T2.

Figure 13A:
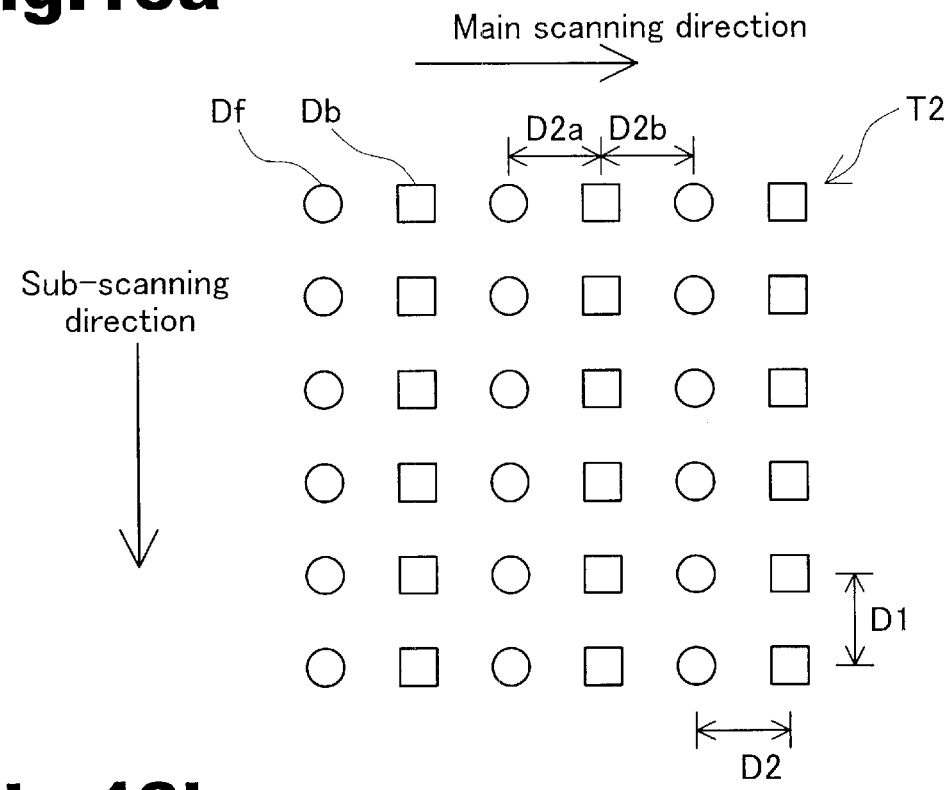
FIGS. 13*a* and 13*b* are diagrams depicting an example of a dot arrangement constituting a gray patch T2.

In FIG. 13, the round dots Df are formed in the forward pass of the carriage 30, and the square dots Db are formed in the reverse pass. The test pattern in FIG. 13*a* is obtained by adopting a procedure in which a row of forward-pass dots Df aligned in the direction of sub-scanning and a row of reverse-pass dots Db aligned in the direction of sub-scanning are alternately arranged in the direction of sub-scanning. The data for the test pattern are organized such that the distance between the center positions of the dots is equal to a constant value D1 in the direction of sub-scanning and to a constant value D2 in the direction of main scanning when the ink drops are ejected with correct timing.

For example, the square dots Db are shifted to the left in the drawing when the timing with which ink drops are ejected in the reverse pass lags behind the perfect timing. This brings about a reduction in the interval D2*a* between the dots Db and the dots Df on the left, and an increase in the interval D2*b* between the dots Db and the dots Df on the right. Conversely, a situation in which ink drops are ejected more rapidly in the reverse pass causes the square dots Db to shift to the right, resulting in an increased interval D2*a* and a reduced interval D2*b*. Such variations can be visually detected by the user as changes in the appearance of the test pattern involved, allowing the user to select a test pattern in which ink drops are recorded by being ejected with correct ejection timing. In addition, adopting an approach in which the dots Df formed in the forward pass and the dots Db formed in the reverse pass are obtained using different ink colors makes it possible to create perceptible color irregularities and other visible changes even when the distance between the dots of different colors varies only slightly. Any dot formation misalignment can therefore be detected with ease.

Figure 13B:
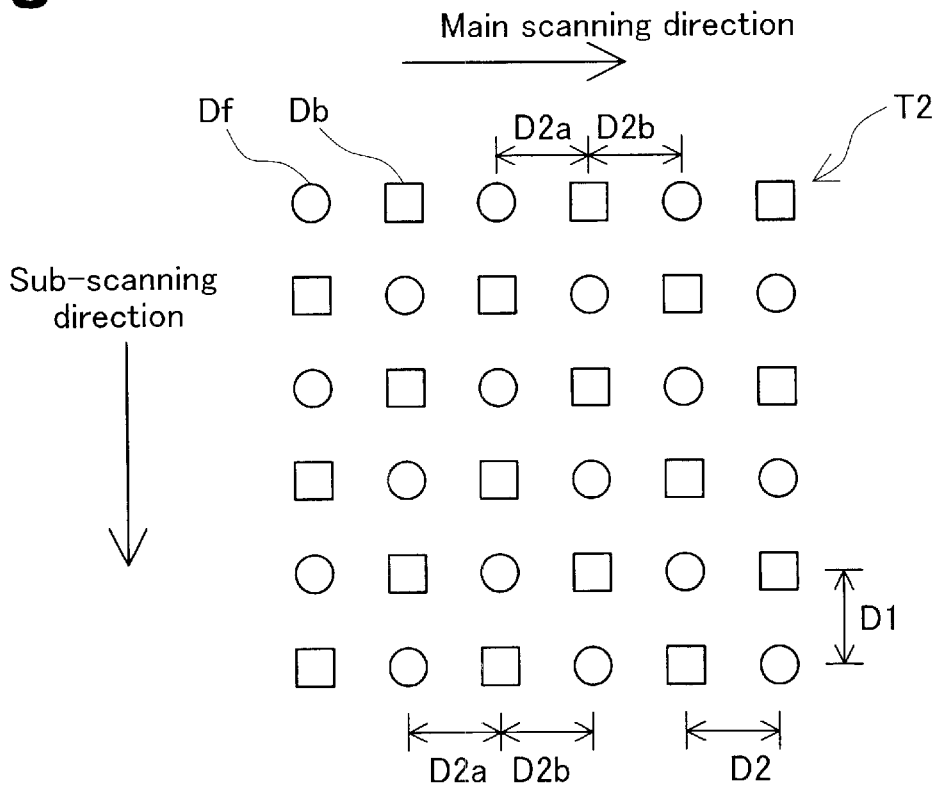

FIG. 13*b* is a diagram depicting another example of the dot arrangement constituting a gray patch T2. In the test pattern shown in FIG. 13*a*, the dots formed in the forward pass are aligned in the direction of sub-scanning, and the dots formed in the reverse pass are aligned in the direction of main scanning. By contrast, the test pattern shown in FIG. 13*b* is configured such that the dots formed in the forward pass and the dots formed in the reverse pass are alternately arranged in the direction of sub-scanning as well. The test pattern shown in FIG. 13*b* is also configured such that the distance between the centers of dots in the direction of main scanning is equal to a constant value D1, and the distance in the direction of sub-scanning is equal to a constant value D2 when the ink drops are ejected with correct timing.

With this test pattern as well, any variation in a dot-recording position brought about by variations in the timing for ejecting ink drops can be visually detected by the user as changes in the appearance of the test pattern involved. The user can therefore select a test pattern in which ink drops are recorded by being ejected according to correct ejection timing. In addition, adopting an approach in which the dots Df formed in the forward pass and the dots Db formed in the reverse pass are obtained using different ink colors makes it possible to create perceptible color irregularities and other visible changes even when the distance between the dots of different colors varies only slightly. Any dot formation misalignment can therefore be detected with ease. Test patterns are not limited to the above-described arrangements and include other options as long as they involve using inks of two or more colors. Nor is it necessary for the patterns to appear to have a gray color.

Measured in the direction of main scanning, the interval between the dots in a test pattern should be 0.5–2.5 mm, and preferably 0.7–1.5 mm. Ideally, the interval should fall within a specific range in the vicinity of 1.0 mm. Measured in the direction of sub-scanning, the interval between the dots in a test pattern should be 0.5–2.5 mm, and preferably 0.7–1.5 mm. Ideally, the interval should fall within a specific range in the vicinity of 1.0 mm.

Figure 14:
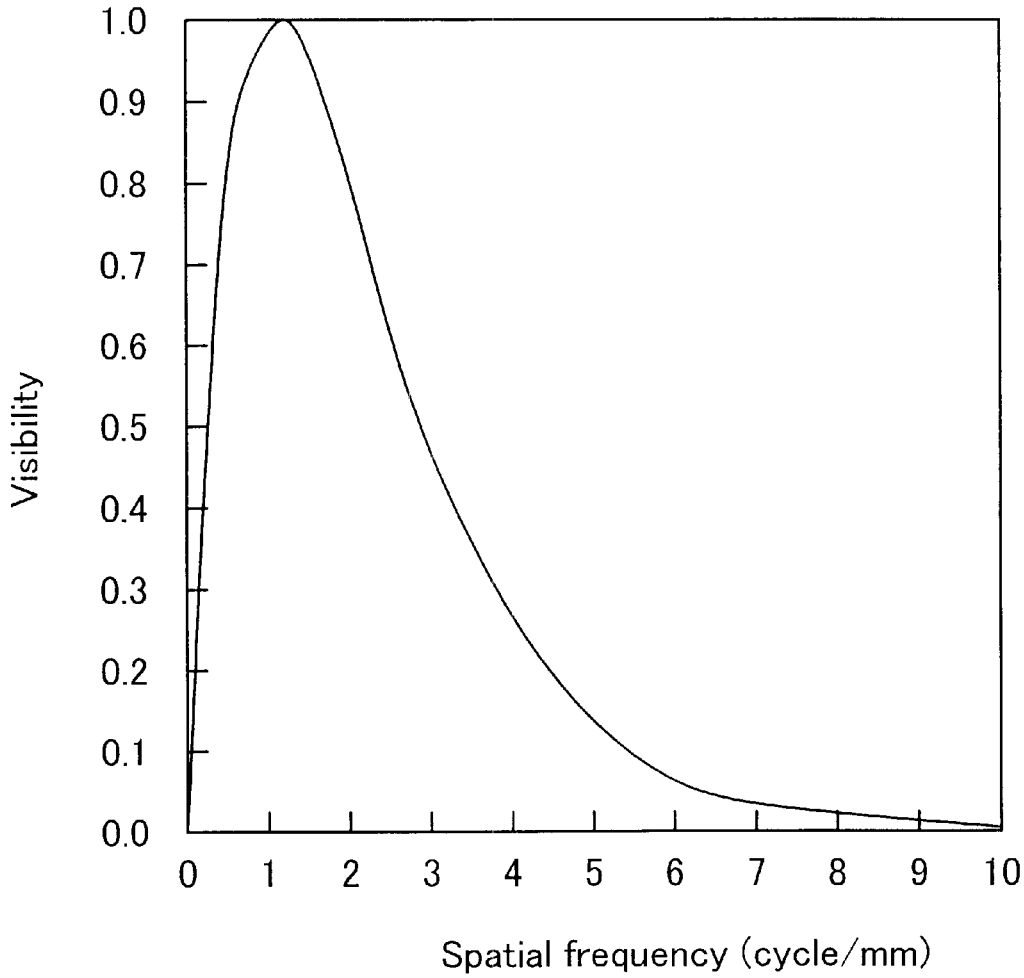
FIG. 14 is a graph depicting the relation between spatial frequency and visibility.

FIG. 14 is a graph depicting the relation between spatial frequency and visibility. This graph, known as the spatial frequency characteristic of vision (VTF: Visual Transfer Function), is obtained by plotting spatial frequency on the horizontal axis, and visibility at each spatial frequency on the vertical axis. It is common knowledge that human visibility in relation to video noise varies with spatial frequency. In the third embodiment, spatial frequency is an inverse of the interval between the dots in a printed test pattern. It can be concluded based on the graph in FIG. 14 that visibility is relatively high at a spatial frequency of 0.4–2.0 cycle/mm and reaches its maximum at about 1 cycle/mm. In the test patterns described above, the dots recorded in the forward pass and the dots recorded in the reverse pass were formed at 0.5 to 2.5-mm intervals. A spatial frequency of 0.4–2.0 cycle/mm corresponds to a dot interval of 0.5–2.5 mm. The spatial frequency falls within a specific range in the vicinity of 1.0 cycle/mm when the interval between dots recorded in the forward pass and dots recorded in the reverse pass falls within a specific range in the vicinity of 1.0 mm. Using such test patterns will therefore make it easy to visually detect even a tiny shift in a dot recording position brought about by a shift in dot-recording timing, and to adjust the dot-recording timing with high precision.

A dot recording position is shifted in the direction of main scanning by a shift in the timing for ejecting ink drops. It is therefore sufficient to select solely in the direction of main scanning a spatial frequency that increases visibility when a test pattern is created. If visibility in relation to brightness is different in the vertical and horizontal directions, it is possible to adopt an approach in which the corresponding visibility-enhancing spatial frequencies are combined to obtain intervals D1 and D2.

F. Modifications

The present invention is not limited to the above-described embodiments or embodiments and can be implemented in a variety of ways as long as the essence thereof is not compromised. For example, the following modifications are possible.

F1. Modification 1

Although light cyan, light magenta, and yellow inks were used for printing gray patches in accordance with the embodiments, the inks that can be used are not limited to these combinations. Specifically, the gray patches can be printed using magenta, cyan, and yellow inks when the inks of these three colors are used as the chromatic color inks of color printing. In addition, when five colors (dark magenta, dark cyan, yellow, light magenta, and light cyan) are used as the chromatic color inks for color printing, the color combinations may not be limited to above three colors (yellow, light magenta, and light cyan), and patches can be printed using other ink combinations. In other words, any color combination is permissible as long as a color patch is formed using two or more single chromatic color nozzle groups.

F2. Modification 2

A rectilinear or other pattern formed with intermittently recorded dots can be used instead of the vertical ruled lines as the first misalignment verification pattern for setting rough adjustment values. In other words, any misalignment verification pattern can be used as long as this pattern allows correction information about the preferred corrected states to be selected and correction values to be determined. Configuring the first misalignment verification pattern as a rectilinear pattern obtained by the intermittent recording of dots allows this pattern to be formed by a single main scan (without a sub-scan) even for nozzles incapable of forming continuous dots in the direction of sub-scanning.

F3. Modification 3

The embodiments were described with reference to cases in which the nozzle groups for ejecting an ink of a single color were arranged as rows of nozzles, but other nozzle arrangements are also possible. In other words, any nozzle assembly is permissible for the nozzle group as long as it can eject an ink of a single color.

F4. Modification 4

The first embodiment was described with reference to a case in which dot formation misalignments were adjusted using rough adjustment values during black-and-white printing. It is also possible, however, to adjust dot formation misalignments with the aid of fine adjustment values during black-and-white printing. In addition, the first embodiment was described with reference to a case in which black ink was used to print patterns for determining rough adjustment values. It is also possible, however, to use one or more types of non-black inks to print patterns for determining the rough adjustment values in an arrangement in which dot recording positions are adjusted using fine adjustment values during black-and-white printing. In other words, the first misalignment verification pattern for determining rough adjustment values can be printed on a print medium by one or more single-color nozzle groups.

F5. Modification 5

According to the first embodiment, vertical ruled lines T12 are formed while their positions in the direction of main scanning are shifted in $1/1440$-inch increments, and a plurality of first possible adjustment values are set at a difference that corresponds to a shift of $1/1440$ inch. It was assumed that the dots of each color in a gray patch were recorded such that their positions in the direction of main scanning in the reverse pass were shifted in $1/2880$-inch increments and that a plurality of second possible adjustment values were set at a difference that corresponded to a shift of $1/2880$ inch. It is also possible to adopt an arrangement in which shift increments are equalized for the vertical ruled lines T12 and the reverse-pass dots of each color in a gray patch, and the same values are selected for the differences between the second possible adjustment values and the differences between the first possible adjustment values.

Such an arrangement allows black-and-white printing, which is characterized by large numbers of characters or diagrams being printed, to be performed such that characters or diagrams only minimally shifted in the direction of main scanning are formed using first adjustment values (rough adjustment values in the first embodiment; see FIG. 6) selected on the basis of ruled lines. Color printing, which is characterized by large numbers of images being printed, can be performed such that images having a minimal grainy feel are formed using second adjustment values (fine adjustment values in the first embodiment; see FIG. 7) selected on the basis of gray patches. Another feature of these arrangements is that the second adjustment values are set in the vicinity of the first adjustment values. The first and second adjustment values designed to cancel shifting can thereby be set with high efficiency when the dot formation misalignments of the nozzles contain dot formation misalignments that are independent of individual nozzles and are common to all the nozzles.

F6. Modification 6

Although the embodiments were described with reference to cases in which misalignments were corrected by adjusting dot recording positions (or recording timings), it is also possible to correct the misalignments by employing other means. For example, it is possible to adopt an arrangement in which such misalignments are corrected by delaying the drive signals sent to the actuator chips or adjusting the frequency of the drive signals.

F7. Modification 7

Although the embodiments were described with reference to cases in which misalignments were corrected by adjusting the recording positions (or recording timings) in the reverse pass, it is also possible to correct such misalignments by adjusting the recording positions in the forward pass. Alternatively, the misalignments may be corrected by adjusting the recording positions both in the forward pass and reverse pass. In other words, misalignments should ordinarily be corrected by adjusting the recording positions in the forward pass and/or reverse pass.

F8. Modification 8

Although the embodiments were described with reference to an inkjet printer, the present invention is not limited to inkjet printers alone and can be adapted to a variety of printing devices in which printing is accomplished with a print head. In addition, the present invention is not limited to methods or devices for ejecting ink drops and includes methods and devices for recording dots by other means.

F9. Modification 9

In the above embodiments, software can be used to perform some of the hardware functions, or, conversely, hardware can be used to perform some of the software functions. For example, some of the functions performed by the head drive circuit 52 shown in FIG. 12 can be performed by software.

INDUSTRIAL APPLICABILITY

The present invention can be adapted to a variety of ink-jet printers and other image output devices for outputting images with the aid of dots.

What is claimed is:

1. A method for setting adjustment values designed to reduce dot formation misalignment in a direction of main scanning during a printing process in which a printing device equipped with a plurality of single-color nozzle groups for ejecting ink drops having mutually different colors is used to deposit the ink drops and to form dots on a print medium while the plurality of single-color nozzle groups and/or the print medium is moved in a main scan, the method comprising the steps of:

(a) selecting a first adjustment value from a plurality of first possible adjustment values using a first misalignment verification pattern; and (b) selecting a second adjustment value from a plurality of second possible adjustment values using a second misalignment verification pattern, which is different from the first misalignment verification pattern, wherein the second misalignment verification pattern is formed on the basis of the selected first adjustment value.

2. An adjustment value determination method as defined in claim 1, wherein the step (b) comprises a step of setting the plurality of second possible adjustment values in a vicinity of the first adjustment value.

3. An adjustment value determination method as defined in claim 2, wherein the step (b) further comprises the step of:

(b1) selecting the second adjustment value from the plurality of second possible adjustment values whose difference is less than a difference between the plurality of first possible adjustment values.

4. An adjustment value determination method as defined in claim 3, wherein the step (a) comprises the steps of:

(a1) forming the first misalignment verification pattern on a print medium by one or more single-color nozzle groups, wherein the first misalignment verification pattern contains a plurality of first sub-patterns associated with the plurality of first possible adjustment values, respectively; and (a2) setting the first adjustment value in accordance with correction information about a preferred corrected state selected from the first misalignment verification pattern; and the step (b) further comprises the steps of:

(b2) forming the second misalignment verification pattern on a print medium by two or more of the single-color nozzle groups, wherein the second misalignment verification pattern contains a plurality of second sub-patterns associated with the plurality of second possible adjustment values, respectively; and (b3) setting the second adjustment value in accordance with correction information about a preferred corrected state selected from the second misalignment verification pattern.

5. An adjustment value determination method as defined in claim 4, wherein the step (a1) comprises the steps of:

(a11) printing first ruled lines each contained in the first sub-pattern and oriented in a direction that intersects the direction of main scanning; and (a12) printing second ruled lines each contained in the first sub-pattern, oriented in a direction that intersects the direction of main scanning and associated with the first ruled line.

6. An adjustment value determination method as defined in claim 5, wherein the adjustment values are designed to reduce dot formation misalignments in the direction of main scanning during a printing process in which ink drops are deposited and dots are formed on a print medium while the main scanning is performed in opposite directions;

the step (a11) comprises the step of:

(a111) printing the first ruled lines in a forward pass of the main scan; and the step (a12) comprises the step of:

(a121) printing the second ruled lines in a reverse pass of the main scan.

7. An adjustment value determination method as defined in claim 5, wherein the step (a11) comprises the step of:

(a112) printing the first ruled lines by a specific single-color nozzle group; and the step (a12) comprises the step of:

(a122) printing the second ruled lines by a single-color nozzle group that is different from the single-color nozzle group used in the printing of the first ruled lines.

8. An adjustment value determination method as defined in claim 4, wherein the step (b2) comprises the step of:

(b21) forming uniform color patches as the second sub-patterns.

9. An adjustment value determination method as defined in claim 4, wherein the adjustment values are designed to reduce dot formation misalignments in the direction of main scanning during a printing process in which ink drops are deposited and dots are formed on a print medium while main scanning is performed in opposite directions; and the step (b2) comprises the step of:

(b21) printing the second sub-patterns in forward and reverse passes of the main scan.

10. An adjustment value determination method as defined in claim 4, wherein the printing device carries out printing process performing sub-scans between main scans, wherein the plurality of single-color nozzle groups and/or the print medium is moved in a direction that intersects the direction of main scanning in the sub-scan; and the step (b2) comprises the step of:

(b21) forming the second sub-patterns while performing sub-scanning between main scans according to a repeating pattern of sub-scanning feed amounts performed between the main scans during image printing.

11. An adjustment value determination method as defined in claim 4, wherein the plurality of single-color nozzle group comprises a plurality of single chromatic color nozzle groups for ejecting single chromatic color inks; and step (b2) comprises the step of:

(b21) forming the second sub-patterns using two or more of the single chromatic color nozzle groups.

12. An adjustment value determination method as defined in claim 11, wherein the plurality of single-color nozzle groups further comprises a single achromatic color nozzle group for ejecting single achromatic color ink;

the step (a1) comprises the step of:

(a13) forming the first misalignment verification pattern using the single achromatic color nozzle group; and the adjustment value determination method further comprises the steps of:

(c) storing the first adjustment value as a value for a first print mode using only the single achromatic color nozzle group; and (d) storing the second adjustment value as a value for a second print mode using at least one of the single chromatic color nozzle groups.

13. An adjustment value determination method as defined in claim 2, wherein the step (a) comprises the steps of:

(a1) forming the first misalignment verification pattern on a print medium such that the first misalignment verification pattern contains a plurality of first sub-patterns associated with the first possible adjustment values, respectively, each first sub-pattern having a first ruled line whose direction intersects the direction of main scanning, and also having a second ruled line associated with the first ruled line and oriented in a direction that intersects the direction of main scanning: and (a2) setting the first adjustment value in accordance with correction information about a preferred corrected state selected from the first misalignment verification pattern; and the step (b) comprises the steps of:

(bi) forming the second misalignment verification pattern on a print medium such that the second misalignment verification pattern contains a plurality of second sub-patterns reproduced as uniform color patches and associated with the second adjustment values, respectively; and (b2) setting the second adjustment value in accordance with correction information about a preferred corrected state selected from the second misalignment verification pattern.

14. An adjustment value determination method as defined in claim 13, wherein the step (bi) comprises the step of:

(b11) forming the second sub-patterns associated with the plurality of second possible adjustment values whose difference is equal to a difference between the plurality of first possible adjustment values.

15. An adjustment value determination method as defined in claim 13, wherein the plurality of single-color nozzle groups includes:

a single achromatic color nozzle group for ejecting single achromatic color ink; and a plurality of single chromatic color nozzle groups for ejecting corresponding single chromatic color inks;

the step (a1) comprises the step of:

(a11) forming the first misalignment verification pattern using the single achromatic color nozzle group;

the step (b1) comprises the step of:

(b11) forming the second sub-patterns using two or more of the single chromatic color nozzle groups; and the adjustment value determination method further comprises the steps of:

(c) storing the first adjustment value as a value for a first print mode using only the single achromatic color nozzle group; and (d) storing the second adjustment value as a value for a second print mode using at least one of the single chromatic color nozzle groups.

16. A method for setting adjustment values designed to reduce dot formation misalignment in a direction of main scanning during a printing process in which a printing device equipped with a plurality of single-color nozzle groups for ejecting ink drops having mutually different colors is used to deposit the ink drops and to form dots on a print medium while the plurality of single-color nozzle groups and/or the print medium is moved in a main scan, the method comprising the steps of:

(a) selecting a first adjustment value from a plurality of first possible adjustment values using a first misalignment verification pattern; and (b) selecting a second adjustment value from a plurality of second possible adjustment values using a second misalignment verification pattern, which is different from the first misalignment verification pattern, wherein the step (b) comprises a step of setting the plurality of second possible adjustment values in a vicinity of the first adjustment value, wherein the step (b) further comprises the step of:

(b1) selecting the second adjustment value from the plurality of second possible adjustment values whose difference is less than a difference between the plurality of first possible adjustment values, (a1) forming the first misalignment verification pattern on a print medium by one or more single-color nozzle groups, wherein the first misalignment verification pattern contains a plurality of first sub-patterns associated with the plurality of first possible adjustment values, respectively; and wherein the step (a) comprises the steps of:

(a2) setting the first adjustment value in accordance with correction information about a preferred corrected state selected from the first misalignment verification pattern; and the step (b) further comprises the steps of:

(b2) forming the second misalignment verification pattern on a print medium by two or more of the single-color nozzle groups, wherein the second misalignment verification pattern contains a plurality of second sub-patterns associated with the plurality of second possible adjustment values, respectively; and (b3) setting the second adjustment value in accordance with correction information about a preferred corrected state selected from the second misalignment verification pattern, wherein the step (b2) comprises the step of:

(b21) forming the second sub-patterns by forming dots such that a value of 0.5–2.5 mm is selected for intervals between the dots formed by ink drops ejected from nozzles in a same single-color nozzle group.

17. A method for setting adjustment values designed to reduce dot formation misalignment in a direction of main scanning during a printing process in which a printing device equipped with a plurality of single-color nozzle groups for ejecting ink drops having mutually different colors is used to deposit the ink drops and to form dots on a print medium while the plurality of single-color nozzle groups and/or the print medium is moved in a main scan, the method comprising the steps of:

(a) selecting a first adjustment value from a plurality of first possible adjustment values using a first misalignment verification pattern; and (b) selecting a second adjustment value from a plurality of second possible adjustment values using a second misalignment verification pattern, which is different from the first misalignment verification pattern, wherein the step (b) comprises a step of setting the plurality of second possible adjustment values in a vicinity of the first adjustment value, wherein the step (a) comprises the steps of:

(a1) forming the first misalignment verification pattern on a print medium such that the first misalignment verification pattern contains a plurality of first sub-patterns associated with the first possible adjustment values, respectively, each first sub-pattern having a first ruled line whose direction intersects the direction of main scanning, and also having a second ruled line associated with the first ruled line and oriented in a direction that intersects the direction of main scanning; and (a2) setting the first adjustment value in accordance with correction information about a preferred corrected state selected from the first misalignment verification pattern; and the step (b) comprises the steps of:

(bi) forming the second misalignment verification pattern on a print medium such that the second misalignment verification pattern contains a plurality of second sub-patterns reproduced as uniform color patches and associated with the second adjustment values, respectively; and (b2) setting the second adjustment value in accordance with correction information about a preferred corrected state selected from the second misalignment verification pattern, wherein the step (bi) comprises the step of:

(b11) forming the second sub-patterns by forming dots such that a value of 0.5–2.5 mm is selected for intervals between the dots formed by ink drops ejected from nozzles included in a same single-color nozzle group.

18. A printing device for performing printing by ejecting ink drops from nozzles, depositing the drops on a print medium to form dots, the printing device comprising:

a plurality of single-color nozzle groups for ejecting ink drops having mutually different colors;

a main scanning unit configured to move the plurality of single-color nozzle groups and/or the print medium in a main scan;

an input unit configured to receive a data input from outside; and a control unit configured to control the printing process; the control unit comprising:

a first pattern-forming unit configured to form on a print medium a first misalignment verification pattern containing a plurality of first sub-patterns associated with first possible adjustment values, respectively, contemplated for use to reduce dot formation misalignments in a direction of main scanning;

a second possible adjustment value setting unit configured to set a plurality of second possible adjustment values contemplated to reduce the dot formation misalignment in the direction of main scanning;

a second pattern-forming unit configured to form on a print medium a second misalignment verification pattern containing a plurality of second sub-patterns associated with the second possible adjustment values, respectively; and a second adjustment value storage unit configured to store a second adjustment value selected from the second possible adjustment values and entered via the input unit, wherein the second misalignment verification pattern is formed on the basis of a selected one of the first possible adjustment values.

19. A printing device as defined in claim 18, wherein the plurality of second possible adjustment values are adjustment values set in a vicinity of a first adjustment value selected from the first possible adjustment values and entered via the input unit.

20. A printing device as defined in claim 19, wherein a difference between the plurality of second possible adjustment values is less than a difference between the plurality of first possible adjustment values.

21. A printing device as defined in claim 20, wherein the first pattern-forming unit is configured to form the first misalignment verification pattern by means of one or more of the single-color nozzle groups; and the second pattern-forming unit forms the second misalignment verification pattern by means of two or more of the single-color nozzle groups.

22. A printing device as defined in claim 21, wherein the control unit is configured to carry out printing process by depositing ink drops and forming dots on a print medium while performing the main scan in opposite directions; and the second pattern-forming unit is configured to print the second sub-patterns in forward and reverse passes of the main scan.

23. A printing device as defined in claim 21, further comprising a sub-scanning unit configured to move the plurality of single-color nozzle groups and/or the print medium in a sub-scan in a direction that intersects the direction of main scanning; wherein the second pattern-forming unit is configured to form the second sub-patterns while performing sub-scanning between main scans according to a repeating pattern of sub-scanning feed amounts performed between the main scans during image printing.

24. A printing device as defined in claim 21, wherein the plurality of single-color nozzle group comprises a plurality of single chromatic color nozzle groups for ejecting single chromatic color inks; and the second pattern-forming unit is configured to form the second sub-patterns using two or more of the single chromatic color nozzle groups.

25. A printing device as defined in claim 24, wherein the control unit further comprises a first adjustment value storage unit configured to store the first adjustment value; wherein the plurality of single-color nozzle groups further comprises a single achromatic color nozzle group for ejecting single achromatic color ink;

the first pattern-forming unit is configured to form the first misalignment verification pattern using the single achromatic color nozzle group; and the control unit further comprises:

a first printing unit configured to carry out printing process using the first adjustment value in the first adjustment value storage unit in a first print mode using only the single achromatic color nozzle group; and a second printing unit configured to carry out printing process using the second adjustment value in the second adjustment value storage unit in a second print mode using at least one of the single chromatic color nozzle groups.

26. A printing device as defined in claim 19, wherein the first pattern-forming unit is configured to print:

first ruled lines each contained in the first sub-pattern and oriented in a direction that intersects the direction of main scanning; and second ruled lines each contained in the first sub-pattern, oriented in a direction that intersects the direction of main scanning and associated with the first ruled line.

27. A printing device as defined in claim 26, wherein the control unit is configured to carry out printing process by depositing ink drops and forming dots on a print medium while performing the main scanning in opposite directions; and the first pattern-forming unit is configured to print:

the first ruled lines in a forward pass of the main scan; and the second ruled lines in a reverse pass of the main scan.

28. A printing device as defined in claim 26, wherein the first pattern-forming unit is configured to print:

the first ruled lines by a specific single-color nozzle group; and the second ruled lines by a single-color nozzle group that is different from the single-color nozzle group used in the printing of the first ruled lines.

29. A printing device as defined in claim 19, wherein the second pattern-forming unit is configured to form uniform color patches as the second sub-patterns.

30. A printing device as defined in claim 19, wherein the first sub-pattern comprises:

first ruled line whose direction intersects the direction of main scanning; and second ruled line associated with the first ruled line and oriented in a direction that intersects the direction of main scanning; and the second sub-pattern is reproduced as uniform color patches.

31. A printing device as defined in claim 30, wherein a difference of the plurality of second possible adjustment values is equal to a difference between the plurality of first possible adjustment values.

32. A printing device as defined in claim 30, wherein the control unit further comprises a first adjustment value storage unit configured to store the first adjustment value;

the plurality of single-color nozzle groups comprise:

a single achromatic color nozzle group for ejecting single achromatic color ink; and a plurality of single chromatic color nozzle groups for ejecting corresponding single chromatic color inks;

the first pattern-forming unit is configured to form the first misalignment verification pattern using the single achromatic color nozzle group;

the second pattern-forming unit is configured to form the second sub-patterns using two or more of the single chromatic color nozzle groups; and the control unit further comprises:

a first printing unit configured to carry out printing process using the first adjustment value in the first adjustment value storage unit in a first print mode using only the single achromatic color nozzle group; and a second printing unit configured to carry out printing process using the second adjustment value in the second adjustment value storage unit in a second print mode using at least one of the single chromatic color nozzle groups.

33. A printing device as defined in claim 32, wherein the control unit further comprises a determination unit configured to determine whether printing is performed according to the first or second print mode on the basis of a print data input; and the first or second print unit prints images on the basis of the decision made by the determination unit.

34. A printing device for performing printing by ejecting ink drops from nozzles, depositing the drops on a print medium to form dots, the printing device comprising:

a plurality of single-color nozzle groups for ejecting ink drops having mutually different colors;

a main scanning unit configured to move the plurality of single-color nozzle groups and/or the print medium in a main scan;

an input unit configured to receive a data input from outside; and a control unit configured to control the printing process;

the control unit comprising:

a first pattern-forming unit configured to form on a print medium a first misalignment verification pattern containing a plurality of first sub-patterns associated with first possible adjustment values, respectively, contemplated for use to reduce dot formation misalignments in a direction of main scanning;

a second possible adjustment value setting unit configured to set a plurality of second possible adjustment values contemplated to reduce the dot formation misalignment in the direction of main scanning;

a second pattern-forming unit configured to form on a print medium a second misalignment verification pattern containing a plurality of second sub-patterns associated with the second possible adjustment values, respectively; and a second adjustment value storage unit configured to store a second adjustment value selected from the second possible adjustment values and entered via the input unit, wherein the plurality of second possible adjustment values are adjustment values set in a vicinity of a first adjustment value selected from the first possible adjustment values and entered via the input unit, wherein a difference between the plurality of second possible adjustment values is less than a difference between the plurality of first possible adjustment values, wherein the first pattern-forming unit is configured to form the first misalignment verification pattern by means of one or more of the single-color nozzle groups, and the second pattern-forming unit is configured to form the second misalignment verification pattern by means of two or more of the single-color nozzle groups, wherein the second pattern-forming unit is configured to form the second sub-patterns by forming dots such that a value of 0.5–2.5 mm is selected for intervals between the dots formed by ink drops ejected from nozzles in a same single-color nozzle group.

35. A printing device for performing printing by ejecting ink drops from nozzles, depositing the drops on a print medium to form dots, the printing device comprising:

a plurality of single-color nozzle groups for ejecting ink drops having mutually different colors;

a main scanning unit configured to move the plurality of single-color nozzle groups and/or the print medium in a main scan;

an input unit configured to receive a data input from outside; and a control unit configured to control the printing process;

the control unit comprising:

a first pattern-forming unit configured to form on a print medium a first misalignment verification pattern containing a plurality of first sub-patterns associated with first possible adjustment values, respectively, contemplated for use to reduce dot formation misalignments in a direction of main scanning;

a second possible adjustment value setting unit configured to set a plurality of second possible adjustment values contemplated to reduce the dot formation misalignment in the direction of main scanning;

a second pattern-forming unit configured to form on a print medium a second misalignment verification pattern containing a plurality of second sub-patterns associated with the second possible adjustment values, respectively; and a second adjustment value storage unit configured to store a second adjustment value selected from the second possible adjustment values and entered via the input unit, wherein the plurality of second possible adjustment values are adjustment values set in a vicinity of a first adjustment value selected from the first possible adjustment values and entered via the input unit, wherein the first sub-pattern comprises:

first ruled line whose direction intersects the direction of main scanning; and second ruled line associated with the first ruled line and oriented in a direction that intersects the direction of main scanning; and the second sub-pattern is reproduced as uniform color patches, wherein the second sub-pattern contains dots such that a value of 0.5–2.5 mm is selected for intervals between the dots formed by ink drops ejected from nozzles included in a same single-color nozzle group.

36. A computer-readable medium containing a computer program for forming misalignment verification patterns that are used when adjustment values are determined in a computer with a printing device equipped with a plurality of single-color nozzle groups for ejecting ink drops having mutually different colors in order to reduce dot formation misalignments in a direction of main scanning during a printing process in which ink drops are deposited and dots are formed on a print medium while the plurality of single-color nozzle groups and/or the print medium is moved in a main scan, the computer-readable medium containing a computer program causing the computer to implement the functions of:

forming on a print medium a first misalignment verification pattern containing a plurality of first sub-patterns associated with first possible adjustment values, respectively, contemplated to reduce dot formation misalignments in the direction of main scanning;

setting a plurality of second possible adjustment values contemplated to reduce the dot formation misalignment in the direction of main scanning and selected from a vicinity of a first adjustment value selected from among the first possible adjustment values and entered;

forming on a print medium a second misalignment verification pattern containing a plurality of second sub-patterns associated with the plurality of second possible adjustment values, respectively; and receiving and storing a second adjustment value selected from the second possible adjustment values, wherein the second misalignment verification pattern is formed on the basis of the selected first adjustment value.

37. A computer-readable medium containing a computer program for forming misalignment verification patterns that are used when adjustment values are determined in a computer with a printing device equipped with a plurality of single-color nozzle groups for ejecting ink drops having mutually different colors in order to reduce dot formation misalignments in a direction of main scanning during a printing process in which ink drops are deposited and dots are formed on a print medium while the plurality of single-color nozzle groups and/or the print medium is moved in a main scan, the computer-readable medium containing a computer program causing the computer to implement the functions of:

forming on a print medium a first misalignment verification pattern containing a plurality of first sub-patterns associated with first possible adjustment values, respectively, contemplated to reduce dot formation misalignments in the direction of main scanning;

setting a plurality of second possible adjustment values contemplated to reduce the dot formation misalignment in the direction of main scanning and selected from a vicinity of a first adjustment value selected from among the first possible adjustment values and entered;

forming on a print medium a second misalignment verification pattern containing a plurality of second sub-patterns associated with the plurality of second possible adjustment values, respectively;

receiving and storing a second adjustment value selected from the second possible adjustment values, and wherein the computer-readable medium contains data concerning the second sub-patterns, in which dots are formed by ink drops of a same color at 0.5- to 2.5-mm intervals.

* * * * *